US012169089B2

(12) United States Patent
Kim et al.

(10) Patent No.: US 12,169,089 B2
(45) Date of Patent: Dec. 17, 2024

(54) REFRIGERATOR AND METHOD OF CONTROLLING THE SAME

(71) Applicant: LG ELECTRONICS INC., Seoul (KR)

(72) Inventors: Sungwook Kim, Seoul (KR); Sangbok Choi, Seoul (KR); Namsoo Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 276 days.

(21) Appl. No.: 17/773,980

(22) PCT Filed: Oct. 12, 2020

(86) PCT No.: PCT/KR2020/013883
§ 371 (c)(1),
(2) Date: May 3, 2022

(87) PCT Pub. No.: WO2021/091103
PCT Pub. Date: May 14, 2021

(65) Prior Publication Data

US 2022/0341649 A1 Oct. 27, 2022

(30) Foreign Application Priority Data

Nov. 4, 2019 (KR) ..... 10-2019-0139674

(51) Int. Cl.
*F25D 17/06* (2006.01)
*F25D 17/04* (2006.01)
*F25D 29/00* (2006.01)

(52) U.S. Cl.
CPC ..... *F25D 17/065* (2013.01); *F25D 17/045* (2013.01); *F25D 29/003* (2013.01);
(Continued)

(58) Field of Classification Search
CPC .... F25D 17/065; F25D 17/045; F25D 29/003; F25D 2400/34; F25D 2600/34;
(Continued)

(56) References Cited

U.S. PATENT DOCUMENTS 5,375,428 A 12/1994 LeClear et al.
5,809,792 A 9/1998 Song
(Continued)

FOREIGN PATENT DOCUMENTS

CN 1218895 A 6/1999
CN 108885054 A 11/2018
(Continued)

OTHER PUBLICATIONS

Pdf is translation of foreign reference DE 102017221866 A1 (Year: 2019).*
(Continued)

*Primary Examiner* — Henry T Crenshaw
*Assistant Examiner* — Kamran Tavakoldavani
(74) *Attorney, Agent, or Firm* — KED & ASSOCIATES, LLP

(57) ABSTRACT

A method for controlling a refrigerator, includes turning off a cold air transmission unit as a temperature of a storage compartment becomes equal to or less than a second reference temperature while a cold air generator is operated, turning on the cold air transmission unit, upon determining that the temperature of the storage compartment is equal to or greater than a first reference temperature which is greater than the second reference temperature, and calculating, by a controller, an operating ratio of the cold air transmission unit based on ON and OFF time of the cold air transmission unit, determining an output of the cold air transmission unit based on the operating ratio of the cold air transmission unit, and operating the cold air transmission unit with the determined
(Continued)

output, upon determining that the temperature of the storage compartment is equal to or less than the second reference temperature.

17 Claims, 8 Drawing Sheets

(52) U.S. Cl.
CPC ..... *F25D 2400/34* (2013.01); *F25D 2600/02* (2013.01); *F25D 2700/12* (2013.01)

(58) Field of Classification Search
CPC ..... F25D 2600/02; F25D 2700/12; F25D 2317/0666; F25D 2600/06; F25D 2700/121; F25D 2700/122; F25D 2700/123; F25B 2313/0293; F25B 2600/112; F25B 2700/2104
See application file for complete search history.

(56) References Cited

U.S. PATENT DOCUMENTS

| | | | | |
|---|---|---|---|---|
| 9,050,360 | B1 | 6/2015 | Scaringe et al. | |
| 11,067,324 | B2 | 7/2021 | Lee et al. | |
| 2013/0111933 | A1* | 5/2013 | Yoon | F25D 29/003 62/89 |
| 2017/0059228 | A1 | 3/2017 | Hu et al. | |
| 2018/0252452 | A1 | 9/2018 | Hwang et al. | |
| 2018/0363964 | A1 | 12/2018 | Chung et al. | |
| 2019/0323760 | A1* | 10/2019 | Schroeder | F25B 21/00 |
| 2021/0199365 | A1* | 7/2021 | Larson | F25D 17/065 |

FOREIGN PATENT DOCUMENTS

| | | | |
|---|---|---|---|
| DE | 102017221866 | A1 * | 6/2019 |
| EP | 3457059 | | 3/2019 |
| JP | H 10267509 | A | 10/1998 |
| JP | 3604860 | | 12/2004 |
| KR | 10-1997-0022182 | | 5/1997 |
| KR | 10-1998-085104 | | 12/1998 |
| KR | 10-0221875 | | 9/1999 |
| KR | 10-2011-0136101 | | 12/2011 |
| KR | 10-2017-0094551 | | 8/2017 |
| KR | 10-2018-0061753 | | 6/2018 |
| WO | WO 2018/230925 | A1 | 12/2018 |

OTHER PUBLICATIONS

International Search Report and Written Opinion dated Jan. 29, 2021 issued in Application No. PCT/KR2020/013883.
Chinese Office Action dated Apr. 29, 2023 issued in Application 202080076593.3.
Extended European Search Report dated Nov. 8, 2023 issued in Application No. 20885457.0.

* cited by examiner

[Fig. 1]
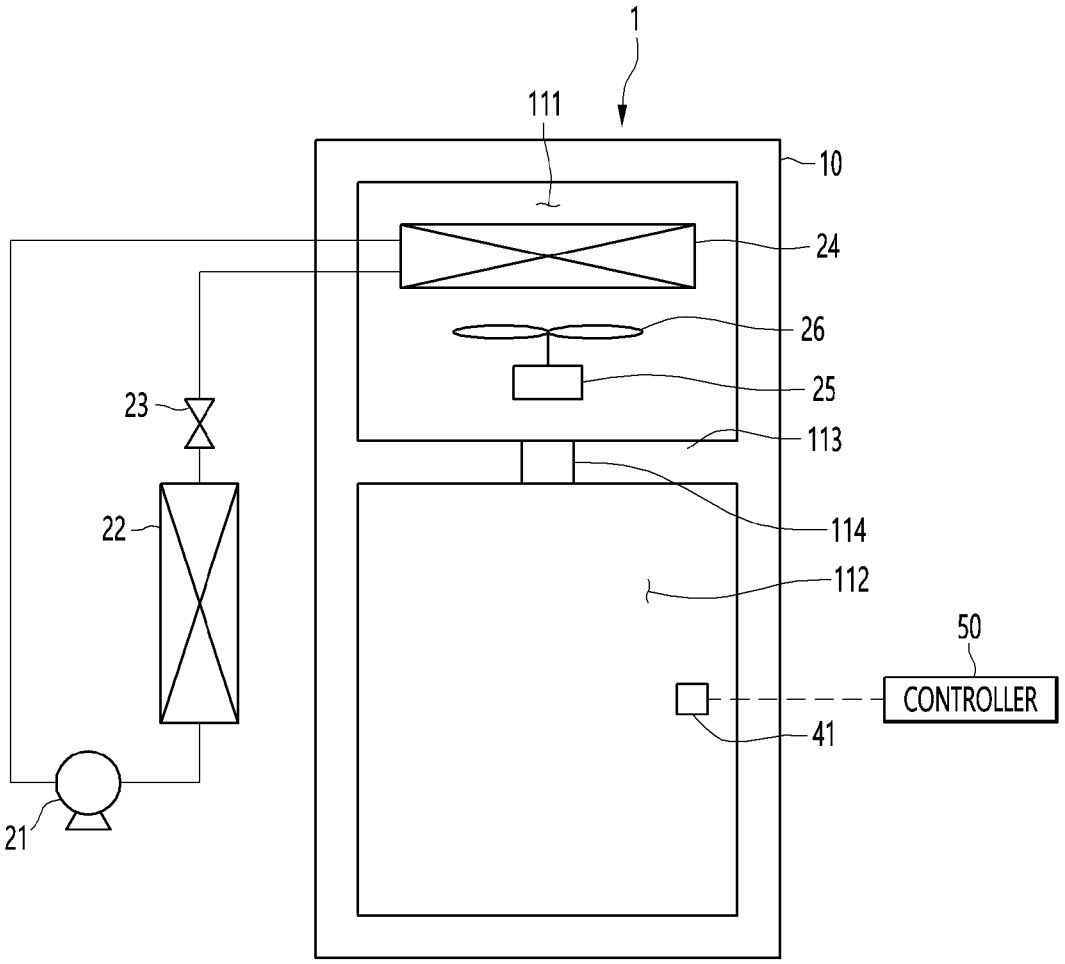
[Fig. 2]
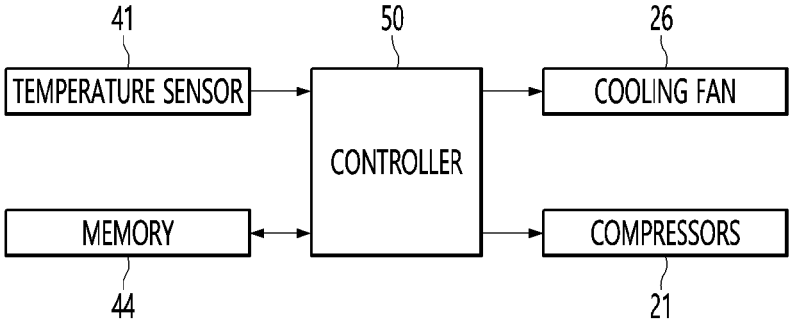

[Fig. 3]
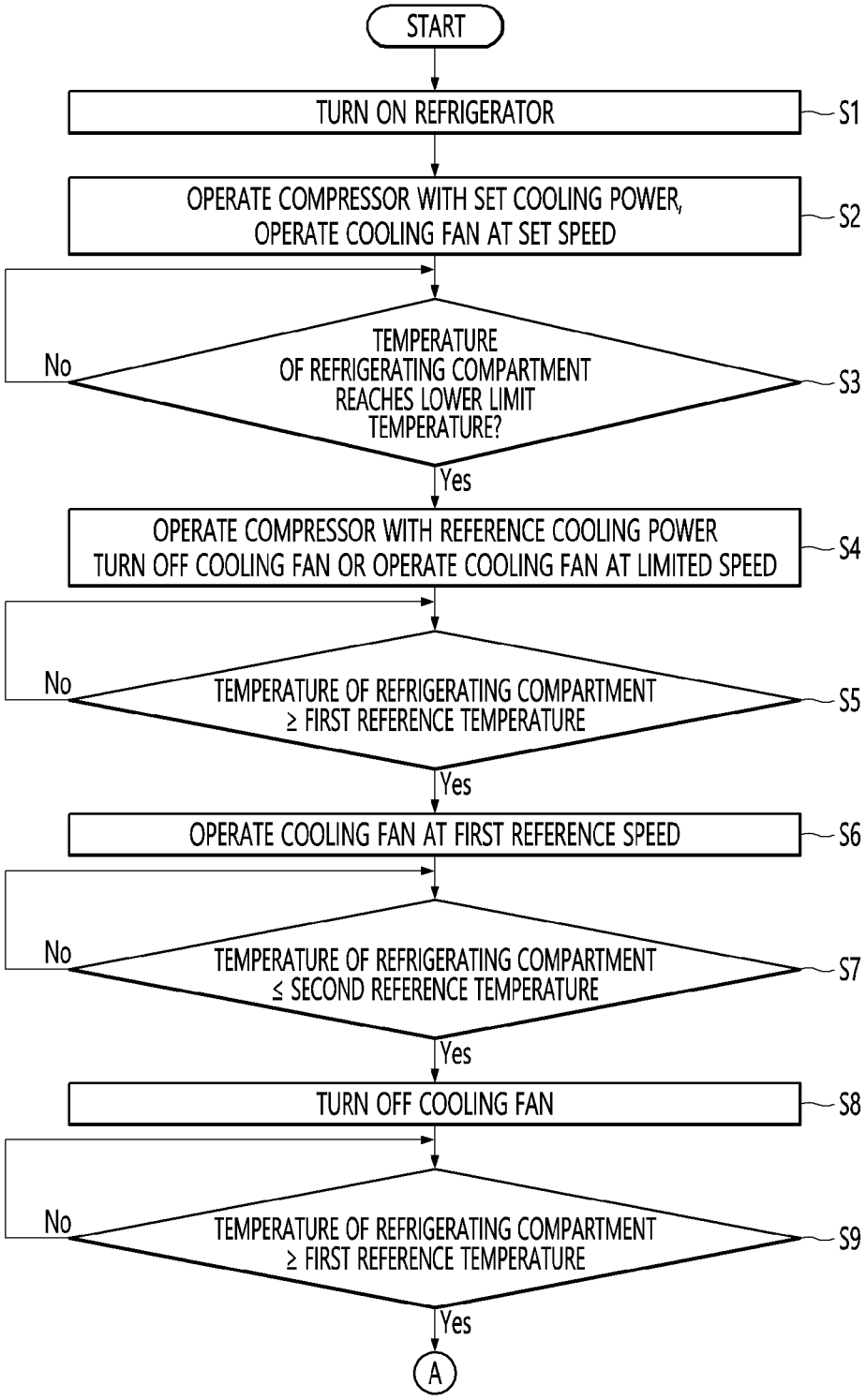

[Fig. 4]
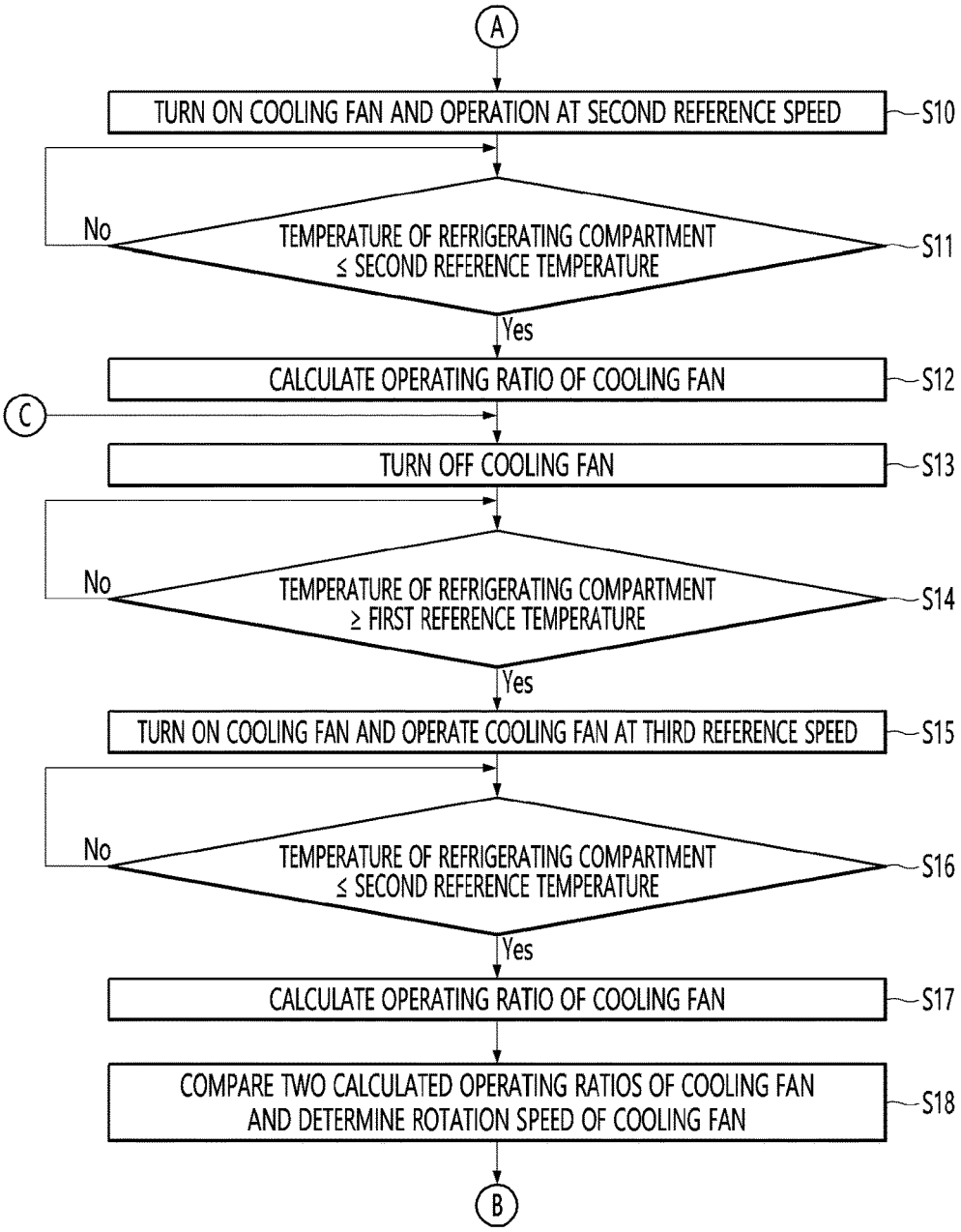
[Fig. 5]
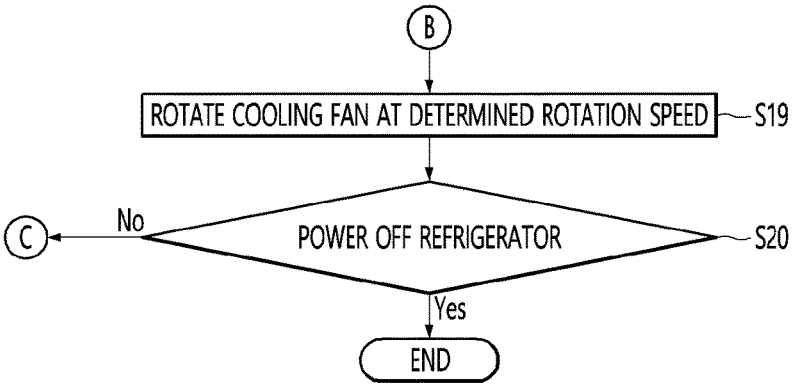

【Figure 6】
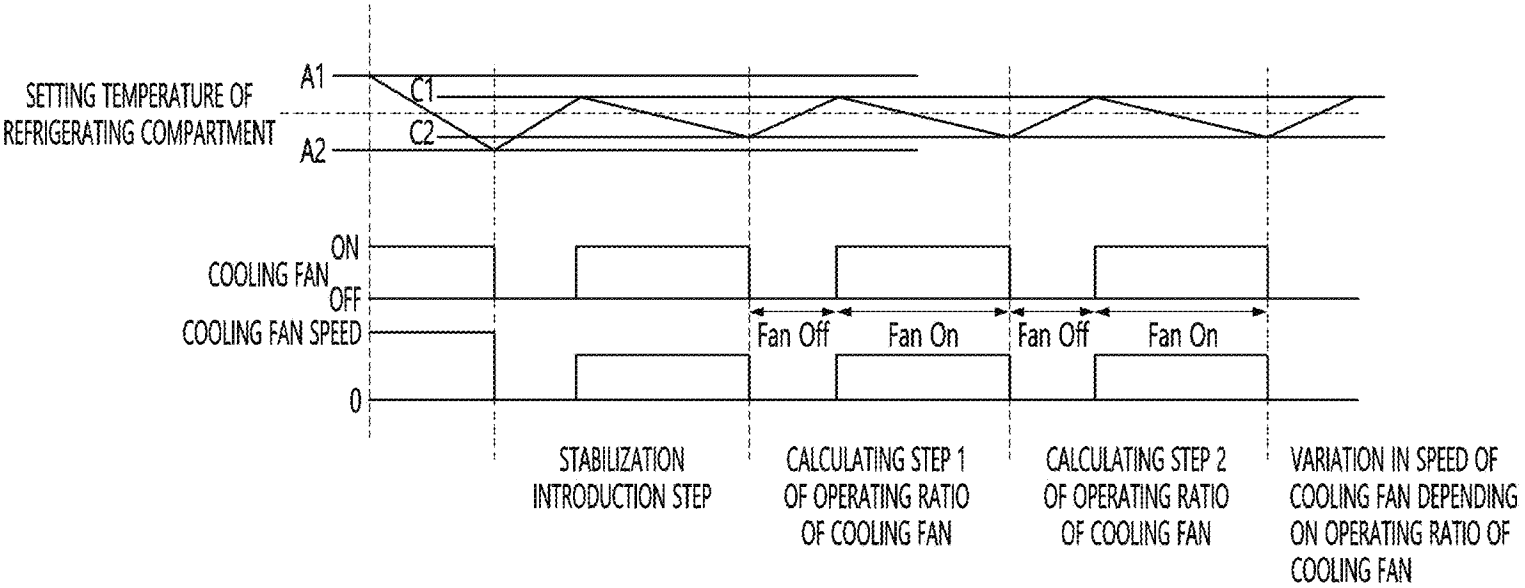

【Figure 7】
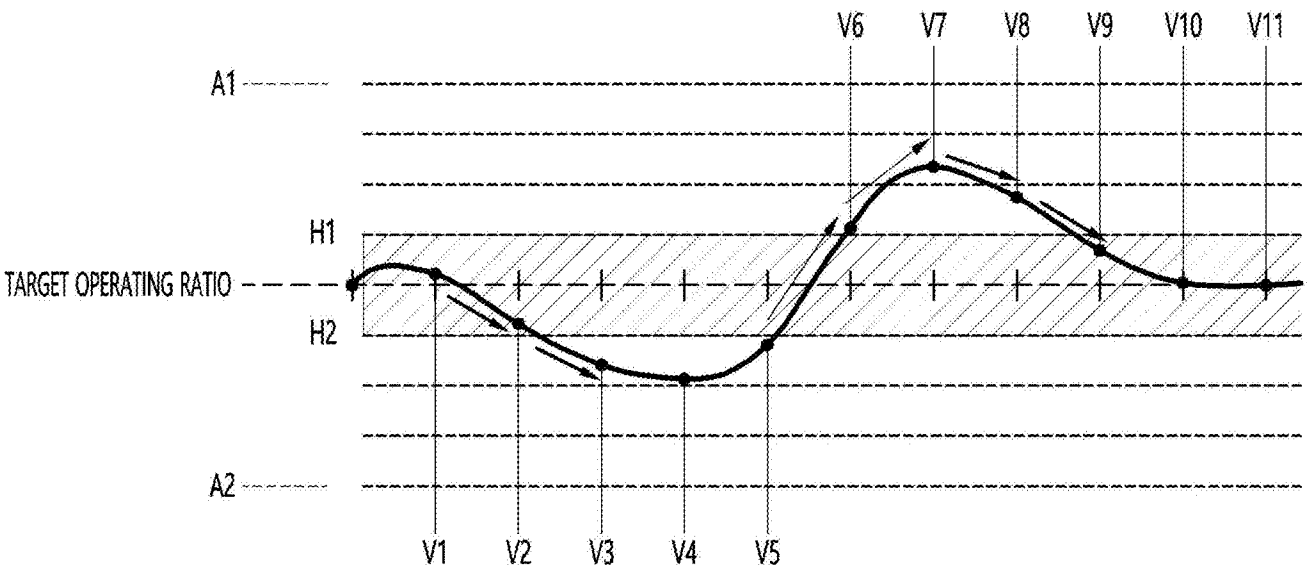

[Fig. 8]
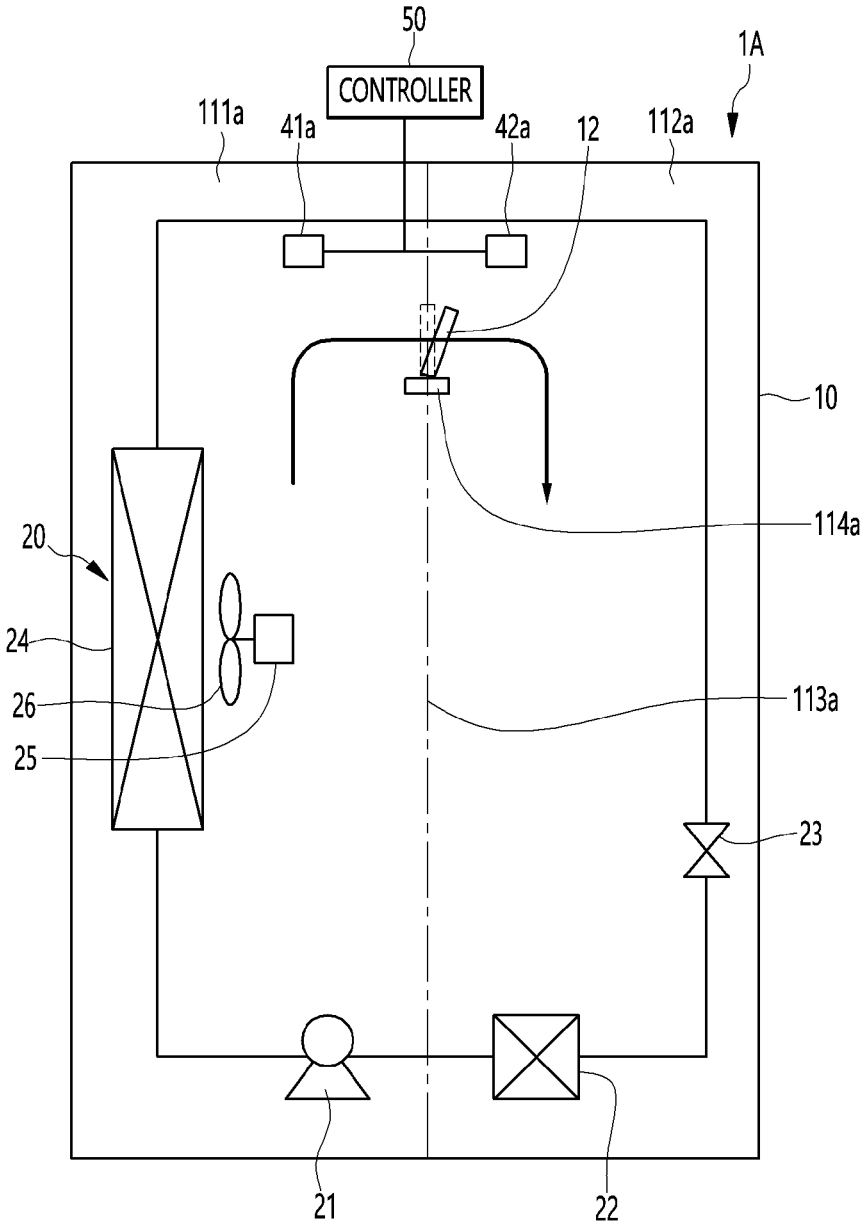

[Fig. 9]
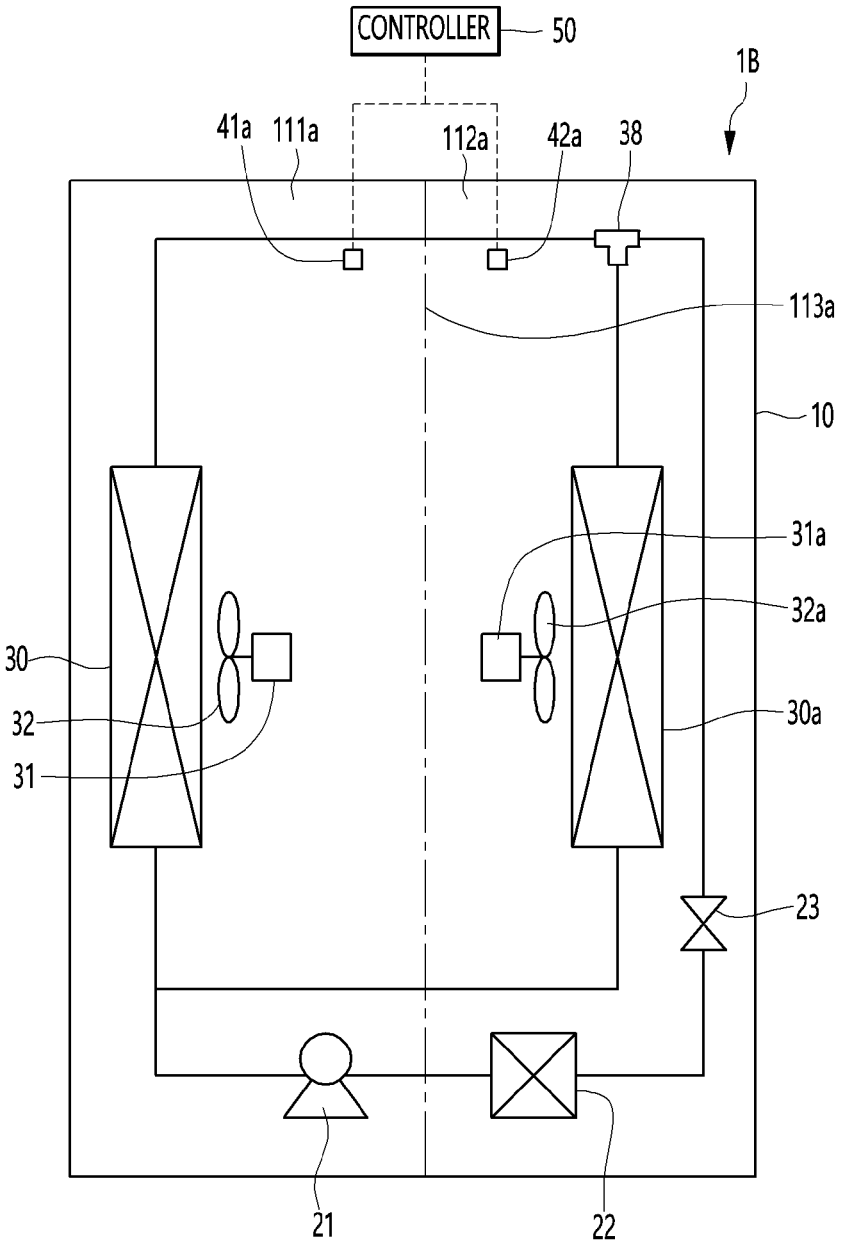

[Fig. 10]
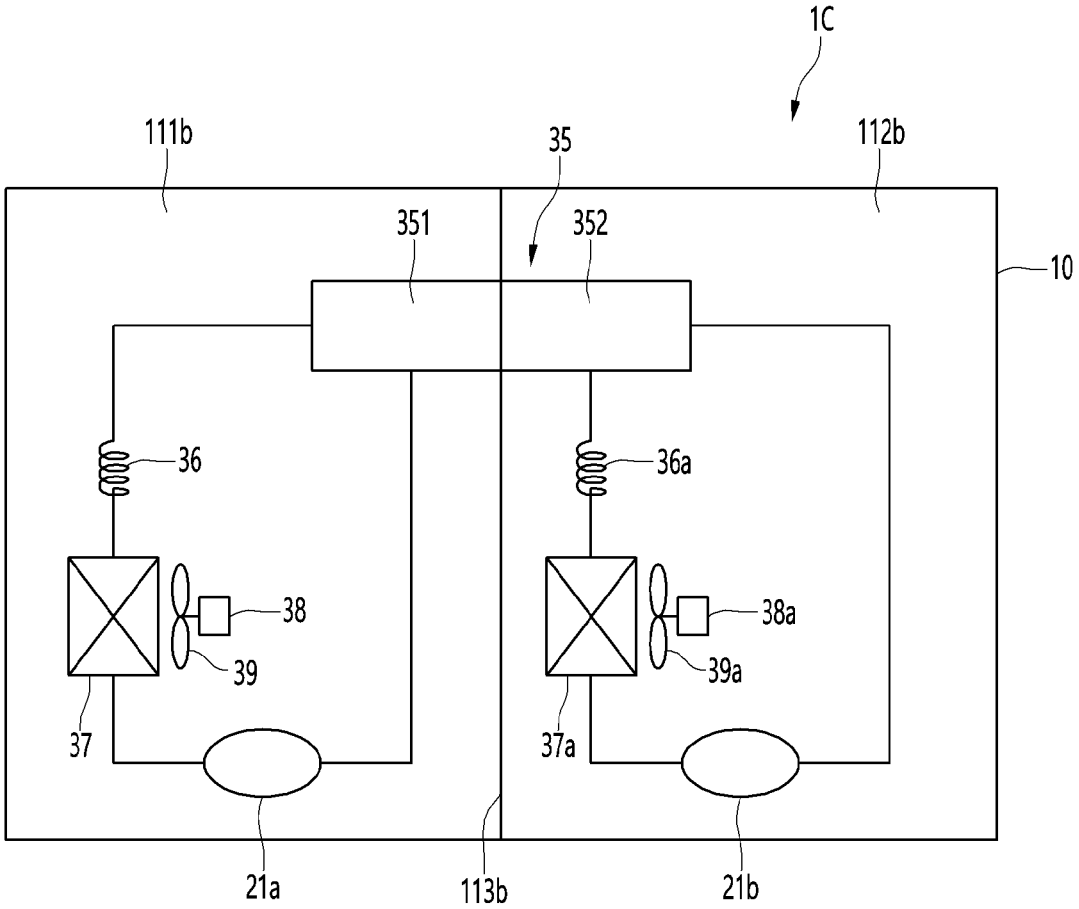

REFRIGERATOR AND METHOD OF CONTROLLING THE SAME

CROSS-REFERENCE TO RELATED PATENT APPLICATIONS

This application is a U.S. National Stage Application under 35 U.S.C. § 371 of PCT Application No. PCT/KR2020/013883, filed Oct. 12, 2020, which claims priority to Korean Patent Application No. 10-2019-0139674, filed Nov. 4, 2019, whose entire disclosures are hereby incorporated by reference.

TECHNICAL FIELD

The present disclosure relates to a refrigerator and a method of controlling the same.

BACKGROUND ART

A refrigerator is a household appliance for storing food at a low temperature. It is essential to always maintain a storage compartment at a constant low temperature. Currently, in case of a household refrigerator, a storage compartment is maintained at a temperature between upper and lower limits based on a set temperature. That is, the refrigerator is controlled using a method of driving a freezing cycle to cool the storage compartment when the temperature of the storage compartment increases to an upper limit temperature and stopping the freezing cycle when the temperature of the storage compartment reaches a lower limit temperature.

Korean Unexamined Patent Publication No. 1997-0022182 (Publication Date: May 28, 1997) (hereinafter referred to as Prior Art 1) discloses a constant temperature control method of maintaining a storage compartment of a refrigerator at a constant temperature.

Prior art 1 does not disclose adjusting the output of a cooling fan based on the operating ratio of a cold air transmission unit such as a cooling fan.

Korean Unexamined Patent Document 10-2018-0061753 (published on Jun. 8, 2018) (hereinafter, referred to as Prior Art 2) discloses a technology to determine a cooling output of a cooling unit based on the sum of a cooling output previously determined and a delaying output.

Prior art 2 does not disclose varying a cooling output of the cooling unit as the cooling unit is continuously operated without being stopped, or adjusting the output of a cooling fan based on the operating ratio of a cold air transmission unit such as a cooling fan.

DISCLOSURE OF INVENTION

Technical Problem

The present embodiment provides a refrigerator which is controlled to maintain a temperature of a storage compartment in a temperature satisfaction range in order to improve freshness of an object to be stored, and a method of controlling the same.

Alternatively or additionally, the present embodiment provides a refrigerator capable of controlling the temperature of a storage compartment to be maintained within a temperature satisfaction range even if a damper is absent in a duct, in the storage compartment to receive cold air through the duct, and a method for controlling the same.

Alternatively or additionally, the present embodiment provides a refrigerator capable of preventing the output of a cold air transmission unit from being determined not to be proper by performing a temperature stabilization operation at an initial stage, and a method for controlling the same.

Alternatively or additionally, the present embodiment provides a refrigerator capable of rapidly recovering a constant temperature state when the temperature of a storage compartment is out of a temperature satisfaction range, and when the temperature of the storage compartment is rapidly out of a constant temperature state.

Solution to Problem

According to an aspect of the present disclosure, a method for controlling a refrigerator may include turning off a cold air transmission unit as a temperature of a storage compartment becomes equal to or less than a second reference temperature while a cold air generator is operated, turning on the cold air transmission unit, upon determining that the temperature of the storage compartment is equal to or greater than a first reference temperature which is greater than the second reference temperature, and calculating, by a controller, an operating ratio of the cold air transmission unit based on an ON time and an OFF time of the cold air transmission unit, determining an output of the cold air transmission unit based on the operating ratio of the cold air transmission unit, and operating the cold air transmission unit with the determined output, upon determining that the temperature of the storage compartment is equal to or less than the second reference temperature.

The cold air generator may be a compressor, and the cold air transmission unit may be a cooling fan which operates to provide cold air to the storage compartment or a damper which opens or closes a passage for providing the cold air to the storage compartment.

The output of the cold air transmission unit may be a rotation speed of the cooling fan, if the cold air transmission unit is the cooling fan.

The storage compartment may receive the cold air from an additional storage compartment communicating with the storage compartment by the cold air transmission unit. The temperature of the additional storage compartment may be maintained to be lower than the temperature of the storage compartment.

The output of the cold air transmission unit may be an open angle of the damper, if the cold air transmission unit is the damper.

The cold air transmission unit may be turned off again when the temperature of the storage compartment is equal to or less than the second reference temperature.

The operating ratio of the cold air transmission unit may be a ratio of the ON time to a sum of the ON time and the OFF time of the cold air transmission unit.

The controller may determine the output of the cold air transmission unit based on a difference between a previous operating ratio of the cold air transmission unit and a current operating ratio of the cold air transmission unit.

The controller may determine the output of the cold air transmission unit to be increased or decreased, when an absolute value of the difference between the previous operating ratio and the current operating ratio is equal to or greater than a first reference value. The controller may determine the output of the cold air transmission unit to be maintained, when the absolute value of the difference between the previous operating ratio and the current operating ratio is less than the first reference value.

The controller may determine the output of the cold air transmission unit to be increased, when the difference between the previous operating ratio and the current operating ratio is less than '0', and when the absolute value of the difference between the previous operating ratio and the current operating ratio is equal to or greater than the first reference value.

The controller may determine the output of the cold air transmission unit to be decreased, when the difference between the previous operating ratio and the current operating ratio is greater than zero, and when the absolute value of the difference between the previous operating ratio and the current operating ratio is equal to or greater than the first reference value.

The controller may determine the output of the cold air transmission unit to be increased or decreased by a first level, when the absolute value of the difference between the previous operating ratio and the current operating ratio is equal to or greater than the first reference value, and less than a second reference value which is greater than the first reference value.

The controller may determine the output of the cold air transmission unit to be increased or decreased by a second level which is greater than the first level, when the absolute value of the difference between the previous operating ratio and the current operating ratio is equal to or greater than the second reference value.

The controller may determine the output of the cold air transmission unit based on a difference between a reference operating ratio, which is previously determined, and a current operating ratio of the cold air transmission unit.

The controller may determine the output of the cold air transmission unit to be increased or decreased, when an absolute value of the difference between the reference operating ratio and the current operating ratio is equal to or greater than a first reference value, and The controller may determine the output of the cold air transmission unit to be maintained, when the absolute value of the difference between the reference operating ratio and the current operating ratio is less than the first reference value.

The controller may determine the output of the cold air transmission unit to be increased, when the difference between the reference operating ratio and the current operating ratio is less than zero, and when the absolute value of the difference between the reference operating ratio and the current operating ratio is equal to or greater than the first reference value.

The controller may determine the output of the cold air transmission unit to be decreased, when the difference between the reference operating ratio and the current operating ratio is greater than zero, and when the absolute value of the difference between the reference operating ratio and the current operating ratio is equal to or greater than the first reference value.

The controller may determine the output of the cold air transmission unit to be increased or decreased by a first level, when the absolute value of the difference between the reference operating ratio and the current operating ratio is equal to or greater than the first reference value, and less than a second reference value which is greater than the first reference value.

The controller may determine the output of the cold air transmission unit to be decreased or increased by a second level which is greater than the first level, when the absolute value of the difference between the reference operating ratio and the current operating ratio is equal to or greater than the second reference value.

The controller may determine the output of the cold air transmission unit based on a first factor which is a difference between a previous operating ratio of the cold air transmission unit and a current operating ratio of the cold air transmission unit, and a second factor which is a difference between a reference operating ratio, which is previously determined, and the current operating ratio of the cold air transmission unit.

The controller may determine whether to increase, maintain, decrease the output of the cold air transmission unit at a final stage by combining a result from the first factor with a result from the second factor, after determining the output of the cold air transmission unit based on the first factor, and determining the output of the cold air transmission unit based on the second factor.

The controller may control the cold air transmission unit to immediately operate with the determined output, upon determining that the temperature of the storage compartment is equal to or less than the second reference temperature.

The cold air transmission unit may be turned off again upon determining that the temperature of the storage compartment is equal to or less than the second reference temperature, and the controller may determine a next output of the cold air transmission unit based on the operating ratio of the cold air transmission unit, and controls the cold air transmission unit to operate with the determined output, when the cold air transmission unit is turned on a next time.

According to another aspect of the present disclosure, a refrigerator may include a first storage compartment, a second storage compartment that receives cold air to cool the first storage compartment, a temperature sensor that senses a temperature of the second storage compartment, a cooling fan that supplies the cold air to the second storage compartment, a compressor that operates to cool the first storage compartment, and a controller that controls the cooling fan.

The controller may repeatedly turn on and off the cooling fan based on the temperature of the second storage compartment such that the temperature of the second storage compartment is maintained in a range of a first reference temperature and a second reference temperature lower than the first reference temperature.

The controller may determine an output of the cooling fan based on an operating ratio of the cooling fan, which is a ratio of an ON time to a sum of the ON time and an OFF time of the cooling fan, and controls the cooling fan to operate with the determined output.

The controller may determine the output of the cooling fan, based on at least one of a difference between a previous operating ratio of the cold air transmission unit and a current operating ratio of the cold air transmission unit or a difference between a reference operating ratio, which is previously determined, and the current operating ratio of the cold air transmission unit.

The output of the cooling fan may be a rotation speed of the cooling fan.

Advantageous Effects of Invention

According to an embodiment, since the output of the cold air transmission unit is varied based on the operating ratio of the cold air transmission unit, the temperature of the storage compartment may be maintained with the temperature satisfaction range. Accordingly, the freshness of an object to be stored may be improved.

Since the cooling power of the cold air transmission unit is adjusted in a plurality of levels, the temperature of the storage compartment may be returned to be in the temperature satisfaction range, even if the temperature of the storage compartment is rapidly increased or decreased.

BRIEF DESCRIPTION OF DRAWINGS

FIG. 1 is a diagram schematically showing the configuration of a refrigerator according to a first embodiment of the present disclosure.

FIG. 2 is a block diagram of a refrigerator according to a first embodiment of the present disclosure.

FIGS. 3 to 5 are flowcharts illustrating a method of controlling a refrigerator according to a first embodiment of the present disclosure.

FIG. 6 is a view showing a temperature change of a refrigerating compartment and an operation state of a cooling fan over time.

FIG. 7 is a graph illustrating the variation in an operating ratio of a cold air transmission unit and an output control of the cold air transmission unit.

FIG. 8 is a view schematically illustrating the configuration of the refrigerator according to a second embodiment of the present disclosure.

FIG. 9 is a view schematically illustrating the configuration of the refrigerator according to a third embodiment of the present disclosure.

FIG. 10 is a view schematically illustrating the configuration of the refrigerator according to a fourth embodiment of the present disclosure.

MODE FOR THE INVENTION

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a diagram schematically showing the configuration of a refrigerator according to a first embodiment of the present disclosure, and FIG. 2 is a block diagram of a refrigerator according to a first embodiment of the present disclosure.

Referring to FIGS. 1 and 2, the refrigerator 1 according to the first embodiment of the present disclosure may include a cabinet 10 in which a storage compartment (or space) is formed and a storage compartment door coupled to the cabinet 10 to open and close the storage compartment.

The storage compartment may include a freezing compartment (or space) 111 and a refrigerating compartment (or space) 112. Objects to be stored such as food may be stored in the freezing compartment 111 and the refrigerating compartment 112.

Although FIG. 1 shows, for example, a refrigerator in which the freezing compartment 111 and the refrigerating compartment 112 are arranged in a vertical direction, in the present disclosure, arrangement of the freezing compartment and the refrigerating compartment is not limited and the type of the refrigerator is not limited.

For example, the freezing compartment 111 may be located above the refrigerating compartment 112.

The freezing compartment 111 and the refrigerating compartment 112 may be partitioned in the vertical direction inside the cabinet 10 by a partitioning wall 113. In the partitioning wall 113, a cold air duct 114 for providing a cold air passage for supplying cold air of the freezing compartment 111 to the refrigerating compartment 112 may be provided.

The refrigerator 1 may further include a freezing cycle for cooling the freezing compartment 111 and/or the refrigerating compartment 112.

The freezing cycle may include at least one of a compressor 21 for compressing refrigerant, a condenser 22 for condensing the refrigerant which has passed through the compressor 21, an expansion member 23 for expanding the refrigerant which has passed through the condenser 22, and an evaporator 24 for evaporating the refrigerant which has passed through the expansion member 23.

The evaporator 24 may include, for example, a freezing compartment evaporator. That is, the cold air heat-exchanged with the evaporator 24 may be supplied to the freezing compartment 111, and the cold air of the freezing compartment 111 may be supplied to the refrigerating compartment 112 through the cold air duct 114.

In another example, in the cabinet 10, the cold air duct 114 may be disposed at a position other than the partitioning wall 113 such that the cold air of the freezing compartment 111 is guided to the refrigerating compartment 112.

The refrigerator 1 may include a cooling fan 26 for allowing air to flow toward the evaporator 24 for circulation of cold air of the freezing compartment 111 and a fan driving unit 25 for driving the cooling fan 26.

The damper may not be provided in the cold air duct 114. According to the present embodiment, the amount of cold air supplied to the refrigerating compartment 112 may be determined according to ON/OFF of the cooling fan 26 and the rotation speed (RPM) of the cooling fan 26. The temperature of the refrigerating compartment 112 may be changed by the amount of cold air supplied to the refrigerating compartment 112.

In the present embodiment, in order to supply cold air to the freezing compartment 111, the compressor 21 and the cooling fan 26 (or the fan driving unit 25) need to operate.

In the present disclosure, the compressor 21 and the cooling fan 26 (or the fan driving unit 25) may be collectively referred to as a "cooling unit" which operates to cool the storage compartment.

The cooling unit may include one or more of a cold air generator operating to generate cold air and a cold air transmission unit (cold air transmitter) operating to transmit cold air.

The compressor 21 may be called a cold air generator and the cooling fan 26 may be called a cold air transmission unit (or cold air transmission component).

In the present disclosure, the cooling power (or output) of the cold air generator may mean, for example, the cooling power (or output) of the compressor 21 and the output of the cold air transmission unit may mean, for example, the rotation speed of the cooling fan 26.

The operating ratio of the cold air transmission unit may mean a ratio of an ON time to a sum of the ON time and the OFF time of the cooling fan 26 in one ON/OFF period of the cooling fan 26 (i.e., one operating period or cycle).

Accordingly, the operating ratio of the cold air transmission unit being high mean that the ON time of the cooling fan 26 is long, and the operating ratio of the cold air transmission unit being low means that the ON time of the cooling fan 26 is short.

The refrigerator 1 may further include a temperature sensor 41 for detecting the temperature of the refrigerating compartment 112 and a controller 50 for controlling the cold air generator based on the temperature detected by the temperature sensor 41.

The controller 50 may control one or more of the compressors 21 and the cooling fan 26 such that the temperature of the refrigerating compartment 112 is maintained in a temperature satisfaction range.

For example, the controller 50 may turn on/off the cooling fan 26 or change the rotation speed of the cooling fan 26. The controller 50 may increase, maintain or decrease the cooling power of the compressor 21.

The controller 50 may change the rotation speed of the cooling fan 26 (i.e., an operating property of the cooling fan) based on the operating ratio of the cooling fan 26.

The refrigerator 1 may further include a memory 44. In the memory 44, a set temperature (or a target temperature) may be stored. The set temperature may be input through an input (not shown) or may be a temperature basically set in a product. In the memory 44, information on the operating ratio of the cooling fan 26 may be stored.

In the present disclosure, a temperature higher than the set temperature of the refrigerating compartment 112 may be referred to as a first reference temperature and a temperature lower than the set temperature of the refrigerating compartment 112 may be referred to as a second reference temperature. A temperature higher than the first reference temperature may be referred to as an upper limit temperature, and a temperature lower than the second reference temperature may be referred to as a lower limit temperature.

A range between the first reference temperature and the second reference temperature may be referred to as a temperature satisfaction range. The set temperature may be, for example, an average temperature between the first reference temperature and the second reference temperature.

Hereinafter, a method of controlling a refrigerator in order to maintain the temperature of the refrigerating compartment 112 in the temperature satisfaction range will be described.

FIGS. 3 to 5 are flowcharts illustrating a method of controlling a refrigerator according to a first embodiment of the present disclosure.

FIG. 6 is a view illustrating the variation in the temperature of the refrigerating compartment and the operating state of the cooling fan over time.

Referring to FIGS. 2 to 6, the controller 50 may perform preliminary operation for constant temperature control when the refrigerator 1 is turned on (S1) (or opening and closing of a door are detected).

In the present embodiment, the preliminary operation may be an operation (or operations) for rapidly reducing the temperature of the refrigerating compartment 112.

For example, the controller 50 may perform control such that the compressor 21 operates with cooling power and the cooling fan 26 operates at a set speed (S2). The set speed may be, but the present disclosure is not limited to, the maximum speed.

In the present disclosure, the compressor 21 may be turned on when the temperature of the refrigerating compartment 112 is equal to or greater than the upper limit temperature A1 (or an ON reference temperature).

Generally, when the refrigerator 1 is turned on or the compressor 21 is turned on in a state in which the compressor is turned off, the cold air generator is turned off for defrost or the door is open and closed, the temperature of the refrigerating compartment 112 may be higher than the ON reference temperature A1.

Accordingly, the set cooling power of the compressor 21 may be, for example, maximum cooling power or power close to the maximum cooling power, such that the temperature of the refrigerating compartment 112 rapidly drops. In addition, the set speed of the cooling fan 26 may be, for example, a maximum speed or a speed close to the maximum speed.

When the compressor 21 and the cooling fan 26 operate, the temperature of the refrigerating compartment 112 decreases.

The controller 50 may determine whether the temperature of the refrigerating compartment 112 becomes equal to or less than the lower limit temperature A2 (or a change reference temperature) for example (S3).

Upon determining that the temperature of the refrigerating compartment 112 reaches the lower limit temperature A2 in step S3, the controller 50 may perform control to perform temperature stabilization operation.

That is, the controller 50 may perform control to perform temperature stabilization operation after the preliminary operation is completed (S4 to S6).

The temperature stabilization operation means operation of allowing the temperature of the refrigerating compartment 112 to enter the temperature satisfaction range.

For example, the controller 50 may operate the compressor 21 with reference cooling power (S4).

The reference cooling power may be cooling power between maximum and minimum cooling power of the compressor 21. For example, the reference cooling power may be less than intermediate cooling power between the maximum and minimum cooling power of the compressor 21.

In addition, the controller 50 may perform control such that the cooling fan 26 is turned off or the cooling fan 26 operates at a limited speed (S4).

The limited speed may be, for example, a minimum speed (greater than zero) of the cooling fan 26 or a speed close to the minimum speed.

When the cooling fan 26 is turned off or operated at the limited speed, the temperature of the refrigerating compartment 112 may be increased. In other words, the temperature of the refrigerating compartment 112 may be increased, as an amount of cold air supplied to the refrigerating compartment 112 through the operation of the cooling fan 26 is more reduced as compared to when the cooling fan 26 operates at the set speed.

The controller 50 may determine whether the temperature of the refrigerating compartment 112 is equal to or greater than the first reference temperature during operation of the compressor 21 (S5).

Upon determining that the temperature of the refrigerating compartment 112 is equal to or greater than the first reference temperature C1 in step S5, the controller 50 may operate the cooling fan at a first reference speed in a state in which the compressor 21 operates (S6).

In the present embodiment, the first reference speed may be greater than the limited speed.

For example, when the cooling fan 26 operates at the first reference speed, the first reference speed may be set to decrease the temperature of the refrigerating compartment 112.

In other words, when the cooling fan 26 operates at a first reference speed, an amount of cold air supplied to the refrigerating compartment 112 is increased as compared to when the cooling fan 26 operates at the limited speed, such that the temperature of the refrigerating compartment 112 may be decreased.

The first reference speed may be a fixed speed. In addition, the first reference speed may be varied at least one time. When the first reference speed is varied at least one time, the first reference speed may be changed to a second speed, which is lower than the first speed, from the first speed.

When the cooling fan 26 operates at the first speed, a larger amount of cold air is supplied to the refrigerating compartment 112, thereby increasing the speed of decreasing the temperature of the refrigerating compartment 112.

After the temperature of the refrigerating compartment 112 is decreased to some extent, the rotation speed of the cooling fan 26 is decreased to the second speed, thereby reducing the speed of decreasing the temperature of the refrigerating compartment 112. In this case, the variation per hour in the temperature of the air compressor 10 may be reduced.

In this case, a time point, at which the rotation speed of the cooling fan 26 is changed from the first speed to the second speed, may be determined over time or may be determined based on the temperature of the refrigerating compartment 112. For example, when the setting time is elapsed after the cooling fan 26 is operated at the first speed, the cooling fan 26 may be operated at the second speed. Alternatively, while the cooling fan 26 is operating at the first speed, when the temperature of the refrigerating compartment 112 reaches a specified temperature between the first reference temperature and the second reference temperature, the cooling fan 26 may be operated at the second speed.

The controller 50 may determine whether the temperature of the refrigerating compartment 112 is equal to or less than the second reference temperature (S7).

Upon determining that the temperature of the refrigerating compartment 112 is equal to or less than the second reference temperature in step S7, the controller 50 may perform control to perform constant temperature operation.

The controller 50 may perform control to repeat operation of turning off and then turning on the cooling fan 26 in the constant temperature operation step.

In the present disclosure, a period from when the cooling fan 26 is turned on after being turned off to when the cooling fan is turned off again may be referred to as one operating period.

The controller 50 may calculate the operating ratio of the cooling fan 26 for each operating cycle during two operating cycles and may determine the rotation speed of the cooling fan 26 based on the calculated two operating ratios, in the constant temperature operation step.

The controller 50 may operate the cooling fan 26 such that the cooling fan 26 is rotated at the determined rotation speed in a next operating cycle.

Upon determining that the temperature of the refrigerating compartment 112 is equal to or less than the second reference temperature in step S7, the controller 50 turns off the cooling fan 26 in a state in which operation of the compressor 21 is maintained (S8).

When the cooling fan 26 is turned off, the temperature of the refrigerating compartment 112 may increase.

While the temperature of the refrigerating compartment 112 increases, the controller 50 may determine whether the temperature of the refrigerating compartment 112 is equal to or greater than the first reference temperature (S9).

Upon determining that the temperature of the refrigerating compartment 112 is equal to or greater than the first reference temperature C1 in step S9, the controller 50 may turn on the cooling fan 26 and control the cooling fan 26 such that the cooling fan 26 operates at a second reference speed (S10).

In step S10, when the cooling fan 26 operates at the second reference speed, the temperature of the refrigerating compartment 112 may decrease. The second reference speed may be equal to or different from the first reference speed.

The second reference speed may be a fixed speed or may be varied one or more times as described above in association with the first reference speed. Since the case where the second reference speed is varied may be the same as the case where the first reference speed is varied, the details thereof will be omitted.

While the cooling fan 26 operates at the second reference speed, the controller 50 may determine whether the temperature of the refrigerating compartment 112 is equal to or less than the second reference temperature (S11).

Upon determining that the temperature of the refrigerating compartment 112 becomes equal to or less than the second reference temperature in step S11, the controller 50 may calculate the operating ratio of the cooling fan 26 based on the ON time and OFF time of the cooling fan 26 in steps S8 to S10 (S12). The calculated operating ratio of the cooling fan 26 may be stored in the memory 44.

In addition, upon determining that the temperature of the refrigerating compartment 112 becomes equal to or less than the second reference temperature in step S11, the controller 50 may turn off the cooling fan 26 in a state in which operation of the compressor 21 is maintained (S13).

When the cooling fan 26 is turned off, the temperature of the refrigerating compartment 112 may increase.

In a state in which the cooling fan 26 is turned off, the controller 50 may determine whether the temperature of the refrigerating compartment 112 becomes equal to or greater than the first reference temperature C1 (S14).

When the temperature of the refrigerating compartment 112 becomes equal to or greater than the first reference temperature, according to the determination result of step S14, the controller 50 may control the cooling fan 26 such that the cooling fan 26 is turned on and operated at a third reference speed (S15).

In step S15, when the cooling fan 26 is operated at the third reference speed, the temperature of the refrigerating compartment 112 may be reduced.

The third reference speed may be equal to at least one of the first reference speed or the second reference speed, or may be different from the first reference speed and the second reference speed.

The third reference speed may be a fixed speed or may be varied one or more times as described above in association with the first reference speed. Since the case where the third reference speed is varied may be the same as the case where the first reference speed is varied, the details thereof will be omitted.

The controller 50 may determine whether the temperature of the refrigerating compartment 112 is equal to or less than the second reference temperature while the cooling fan 26 is operated at the third reference speed (S16).

Upon determining that the temperature of the refrigerating compartment 112 becomes equal to or less than the second reference temperature in step S16, the controller 50 may calculate the operating ratio of the cooling fan 26 based on the ON time and OFF time of the cooling fan 26 in steps S13 to S15 (S17). The calculated operating ratio of the cooling fan 26 may be stored in the memory 44.

That is, in the memory 44, the operating ratio of the cooling fan 26 may be calculated and stored for each operating period.

For convenience of description, the operating ratio calculated in step S12 may be referred to as a previous operating ratio and the operating ratio calculated in step S17 may be referred to as a current operating ratio.

When the current operating ratio is calculated, the controller 50 may compare the previous operating ratio with the current operating ratio and determine the cooling power of the compressor 21 (S18).

The controller 50 may rotate the cooling fan 26 at a determined rotation speed (S19). In other words, the controller 50 may perform a control operation such that the cooling fan 26 is operated at the determined rotation speed in a next operating cycle.

When one operating cycle is terminated at a time point at which the cooling fan 26 is turned off as illustrated in FIG. 6, the operating ratio of the cooling fan 26 may be determined at the time point at which the cooling fan 26 is turned off. Accordingly, the rotation speed of the cooling fan 26 may be determined at the time point at which the cooling fan 26 is turned off.

When one operating cycle is terminated at a time point at which the cooling fan 26 is turned on, the operating ratio of the cooling fan 26 may be determined at the time point at which the cooling fan 26 is turned on. Accordingly, the rotation speed of the cooling fan 26 may be determined at the time point at which the cooling fan 26 is turned on.

As long as the refrigerator is not powered off (S20), the controller 50 may continuously perform the constant temperature operation to vary the rotation speed of the cooling fan 26 in the state that the compressor 21 is turned on.

For example, when the cooling fan 26 is rotated at the determined rotation speed, the controller 50 may repeatedly perform step S13 to S19.

When steps S13 to S19 are repeatedly performed, the operating ratio of the cooling fan 26 is calculated for each operating period, the last calculated operating ratio becomes a current operating ratio and the previously calculated operating ration becomes a previous operating ratio.

According to the present embodiment, the controller 50 may determine the rotation speed of the cooling fan 26 based on a difference value between the previous operating ratio and the current operating ratio of the cooling fan 26.

For example, when the absolute value of the difference between the previous operating ratio and the current operating ratio of the cooling fan 26 is less than the first reference value, the controller 50 may maintain the rotation speed of the cooling fan 26 to be a current rotation speed. In other words, the controller 50 does not vary the rotation speed of the cooling fan 26.

Alternatively when the absolute value of the difference between the previous operating ratio and the current operating ratio of the cooling fan 26 is equal to or greater than the first reference value, the controller 50 may increase or decrease the rotation speed of the cooling fan 26.

For example, when the difference between the previous operating ratio and the current operating ratio is less than zero and the absolute value of the difference between the previous operating ratio and the current operating ratio is equal to or greater than the first reference value, the rotation speed of the cooling fan 26 may be increased by the first level.

The difference between the previous operating ratio and current operating ratio being less than zero may mean that the current operating ratio is greater than the previous operating ratio.

The current operating ratio being greater than the previous operating ratio means that the operating time of the cooling fan 26 increases. Increasing the operating time of the cooling fan 26 means that a time required for the temperature of the refrigerating compartment 112 to increase from the first reference temperature to reach the second reference temperature increases.

When the cooling fan 26 rotates at a lower rotation speed, a smaller amount of cold air may be supplied to the refrigerating compartment 112.

When an amount of cold air actually supplied to the refrigerating compartment 112 is smaller than an amount of cold air matched with a current load of the refrigerating compartment 112, time, which is taken until the temperature of the refrigerating compartment 112 reaches the second reference temperature from the first reference temperature, may be increased.

Accordingly, according to the present embodiment, when the difference between the previous operating ratio and the current operating ratio is less than zero and the absolute value of the difference between the previous operating ratio and the current operating ratio is equal to or greater than the first reference value, the rotation speed of the cooling fan 26 may be increased by the first level.

For example, when the difference between the previous operating ratio and the current operating ratio is greater than zero and the absolute value of the difference between the previous operating ratio and the current operating ratio is equal to or greater than the first reference value, the rotation speed of the cooling fan 26 may be increased by the first level.

The difference between the previous operating ratio and the current operating ratio being greater than zero means that the current operating ratio is less than the previous operating ratio.

The current operating ratio being less than the previous operating ratio means that the operating time of the cooling fan 26 decreases. Decreasing the operating time the cooling fan 26 means that a time required for the temperature of the refrigerating compartment 112 to increase from the first reference temperature to reach the second reference temperature decreases.

When the cooling fan 26 rotates at a higher rotation speed, a larger amount of cold air may be supplied to the refrigerating compartment 112.

When an amount of cold air actually supplied to the refrigerating compartment 112 is larger than an amount of cold air matched with a current load of the refrigerating compartment 112, time, which is taken until the temperature of the refrigerating compartment 112 reaches the second reference temperature from the first reference temperature, may be decreased.

Accordingly, according to the present embodiment, when the difference between the previous operating ratio and the current operating ratio is greater than zero and the absolute value of the difference between the previous operating ratio and the current operating ratio is equal to or greater than the first reference value, the rotation speed of the cooling fan 26 may be decreased by the first level.

In the present embodiment, a plurality of reference values for comparison with the absolute value of the difference between the previous operating ratio and the current operating ratio may be set.

For example, when the difference between the previous operating ratio and the current operating ratio is less than zero and the absolute value of the difference between the previous operating ratio and the current operating ratio is equal to or greater than the second reference value which is greater than the first reference value, the rotation speed of the cooling fan 26 may be increased by the second level.

Alternatively, when the absolute value of the difference between the previous operating ratio and the current operating ratio is equal to or greater than a third reference value which is greater than the second reference value, the rotation speed of the cooling fan 26 may be increased by the third level. Alternatively, when the absolute value of the difference between the previous operating ratio and the current operating ratio is equal to or greater than the third reference value which is greater than the second reference value, the rotation speed of the cooling fan 26 may be determined as the maximum speed.

For example, when the difference between the previous operating ratio and the current operating ratio is greater than zero and the absolute value of the difference between the previous operating ratio and the current operating ratio is equal to or greater than the second reference value which is greater than the first reference value, the rotation speed of the cooling fan 26 may be decreased by the second level.

Alternatively, when the absolute value of the difference between the previous operating ratio and the current operating ratio is equal to or greater than the third reference value which is greater than the second reference value, the rotation speed of the cooling fan 26 may be reduced by the third level. Alternatively, when the absolute value of the difference between the previous operating ratio and the current operating ratio is equal to or greater than the third reference value which is greater than the second reference value, the rotation speed of the cooling fan 26 may be determined as the minimum speed.

At this time, the differences between the plurality of reference values may be equally or differently determined.

For example, the first reference value may be set to B1, the second reference value may be set to 2*B1, and the third reference value may be set to 3*B1. Alternatively, the first reference value may be set to B2, the second reference value may be set to C*B2, and the third reference value may be set to C1*B2. At this time, C1 may have a value greater than C.

In addition, the differences between the plurality of levels may be equally or differently set.

For example, the first level may have a speed change value of D, the second level may have a speed change value of 2*D, and the third level may be set as a speed change value of 3*D.

Alternatively, the first level may have a speed change value of D, the second level may be set to a speed change value of D1 (a value greater than D) instead of the value of 2*D, and the third level may be set to have a speed change value of D2 (a value greater than D1) instead of 3*D.

According to the present embodiment, since the rotation speed of the cooling fan 26 is varied based on the comparison result between the previous operating ratio and the current operating ratio of the cooling fan 26, the temperature of the refrigerating compartment 112 may be maintained within the range of the temperature satisfaction range.

The rotation speed of the cooling fan 26 may converge to a specific rotation speed during a constant temperature operation or may operate at a rotation speed similar to the specific rotation speed. The specific rotation speed of the cooling fan 26 is a speed for actually maintaining the temperature of the refrigerating compartment 112 within the temperature satisfaction range.

Since the temperature of the refrigerating compartment 112 is maintained in the temperature satisfaction range, the temperature change range of the object to be stored, which is stored in the refrigerating compartment 112, may be minimized and freshness of the object to be stored may be maintained.

In addition, since the rotation speed of the cooling fan 26 may be adjusted to a plurality of levels, when the temperature of the refrigerating compartment 112 rapidly increases or decreases (for example, when the door is opened, when the door is opened and cold air having a temperature lower than the temperature of the refrigerating compartment 112 is supplied to the refrigerating compartment 112 or when air outside the refrigerator is supplied to the refrigerating compartment 112), the temperature of the refrigerating compartment 112 may be rapidly returned to the temperature satisfaction range.

The present embodiment will be summarized as follows. In the constant temperature operation step, the rotation speed of the cooling fan 26 is operated at a rotation speed previously determined. When one operating cycle is completed, the current operating ratio of the cooling fan 26 is obtained to determine a rotation speed of the cooling fan 26 to be operated in a next operating cycle, and the cooling fan 26 is rotated at the determined rotation speed.

In the present disclosure, any one of the freezing compartment 111 and the refrigerating compartment 112 may be referred to as a first storage compartment and the other thereof may be referred to as a second storage compartment.

When a temperature sensor is present in the freezing compartment 111, ON and OFF of the cooling fan 26 may be determined according to the temperature change of the freezing compartment 111. In this case, the rotation speed of the cooling fan 26 may be determined based on the operating ratio of the cooling fan 26.

A modified example of the first embodiment will be described.

Although, in the above embodiment, the rotation speed of the cooling fan 26 is determined based on the previous operating ratio and the current operating ratio of the cooling fan 26, the rotation speed of the cooling fan 26 may be determined by the result of comparing the current operating ratio of the cooling fan 26 with a predetermined reference operating ratio. The reference operating ratio may be stored in the memory 44.

In this case, in the method of controlling the refrigerator of FIGS. 3 to 5, steps S13 to S17 may be omitted. In addition, step S18 may be changed to step of changing the rotation speed of the cooling fan 26 by the result of comparing the current operating ratio with the predetermined reference operating ratio (or a target operating ratio).

In addition, unless the refrigerator is turned off after step S19, the method may move to step S8 of FIG. 3 and the constant-temperature operation may be repeatedly performed.

That is, in the constant-temperature operating step, when the current operating ratio of the cooling fan 26 is calculated, the rotation speed of the cooling fan is determined by the result of comparison with the reference operating ratio stored in the memory 44 and the cooling fan 26 may operate with the determined rotation speed in a next operating period.

For example, when the absolute value of the difference between the reference operating ratio and the current operating ratio is less than the first reference value, the controller 50 may maintain the rotation speed of the cooling fan 26 at the current rotation speed. That is, the controller 50 does not change the rotation speed of the cooling fan 26.

Alternatively, when the absolute value of the difference between the reference operating ratio and the current operating ratio is equal to or greater than the first reference value, the rotation speed of the cooling fan 26 may increase or decrease.

For example, when the difference between the reference operating ratio and the current operating ratio is less than zero and the absolute value of the difference between the previous operating ratio and the current operating ratio is equal to or greater than the first reference value, the rotation speed of the cooling fan 26 may increase by the first level.

The reference operating ratio may be experimentally determined such that the temperature of the refrigerating compartment 112 is maintained within the temperature satisfaction range while the cooling fan 26 is rotating at a rotation speed equal to or similar to the specific rotation speed without an external influence, in the state that the door of the refrigerating compartment 112 is closed. The reference operating ratio may not be changed while being stored in the memory 44 or may be varied depending on the type of a refrigerator or an outdoor environment (temperature).

When the difference between the reference operating ratio and the current operating ratio is less than zero and the absolute value of the difference between the reference operating ratio and the current operating ratio is equal to or greater than the first reference value, the rotation speed of the cooling fan 26 may be increased by the first level.

Alternatively, when the difference between the reference operating ratio and the current operating ratio is greater than zero and the absolute value of the difference between the reference operating ratio and the current operating ratio is equal to or greater than the first reference value, the rotation speed of the cooling fan 26 may decrease by the first level.

In the present embodiment, a plurality of reference values for comparison with the absolute value of the difference between the reference operating ratio and the current operating ratio may be set.

For example, when the difference between the reference operating ratio and the current operating ratio is less than zero and the absolute value of the difference between the reference operating ratio and the current operating ratio is equal to or greater than the second reference value greater than the first reference value, the rotation speed of the cooling fan 26 may increase by the second level.

In addition, when the absolute value of the difference between the reference operating ratio and the current operating ratio is equal to or greater than the third reference value greater than the second reference value, the rotation speed of the cooling fan 26 may increase by the third level.

Alternatively, when the difference between the reference operating ratio and the current operating ratio is greater than zero and the absolute value of the difference between the reference operating ratio and the current operating ratio is equal to or greater than the second reference value greater than the first reference value, the rotation speed of the cooling fan 26 may decrease by the second level.

In addition, when the absolute value of the difference between the reference operating ratio and the current operating ratio is equal to or greater than the third reference value greater than the second reference value, the rotation speed of the cooling fan 26 may decrease by the third level.

At this time, differences between the plurality of reference values may be equally or differently set. For example, the first reference value may be set to E1, the second reference value may be set to 2*E1, and the third reference value may be set to 3*E1. Alternatively, the first reference value may be set to E2, the second reference value may be set to F*E2, and the third reference value may be set to F1*E2. At this time, F1 may have a greater value than F.

In addition, differences between the plurality of levels may be equally or differently set. For example, the first level may be set to have a rotation speed change value of G, the second level may be set to have a rotation speed change value of 2*G and the third level may be set to have a rotation speed change value of 3*G.

Alternatively, the first level may be set to have a rotation speed change value of G1, the second level may be set to have a rotation speed change value of G2 (greater than G1) instead of 2*G1, and the third level may be set to have a rotation speed change value of G3 (greater than G2) instead of 3*G1.

Another modified example of the first embodiment will be described.

The controller 50 may maintain the rotation speed of the cooling fan 26 in the current state or may increase or decrease the rotation speed of the cooling fan 26, based on a first factor (the difference between the previous operating ratio and the current operating ratio) and a second factor (the difference between the reference operating ratio and the current operating ratio) for adjusting the rotation speed of the cooling fan 26.

In this modified example, steps S1 to S20 described in the first embodiment may be equally performed.

The controller 50 may determine whether the rotation speed of the cooling fan 26 is increased, maintained or decreased based on the first factor, determine whether the rotation speed of the cooling fan 26 is increased, maintained or decreased based on the second factor, and then finally determine whether the rotation speed of the cooling fan 26 is increased, maintained or decreased based on a combination of the results.

For example, upon determining that the rotation speed of the cooling fan 26 is maintained based on the first factor and determining that the rotation speed of the cooling fan 26 is increased based on the second factor, the rotation speed of the cooling fan 26 is finally increased.

Upon determining that the rotation speed of the cooling fan 26 is maintained based on the first factor and determining that the rotation speed of the cooling fan 26 is decreased based on the second factor, the rotation speed of the cooling fan 26 is finally decreased.

Upon determining that the rotation speed of the cooling fan 26 is maintained based on the first factor and the second factor, the rotation speed of the cooling fan 26 is finally maintained.

Upon determining that the rotation speed of the cooling fan 26 is increased based on the first factor and determining that the rotation speed of the cooling fan 26 is maintained based on the second factor, the rotation speed of the cooling fan 26 is finally increased.

Upon determining that the rotation speed of the cooling fan 26 is decreased based on the first factor and determining that the rotation speed of the cooling fan 26 is maintained based on the second factor, the rotation speed of the cooling fan 26 is finally decreased.

Upon determining that the rotation speed of the cooling fan 26 is increased based on the first factor and the second factor, the rotation speed of the cooling fan 26 is finally increased.

Upon determining that the rotation speed of the cooling fan 26 is decreased based on the first factor and the second factor, the rotation speed of the cooling fan 26 is finally decreased.

Upon determining that the rotation speed of the cooling fan 26 is decreased based on the first factor and determining that the rotation speed of the cooling fan 26 is increased based on the second factor, the rotation speed of the cooling fan 26 may be maintained, increased or decreased according to the level of the rotation speed determined as being decreased based on the first factor and the level of the rotation speed determined as being increased based on the second factor.

Upon determining that the rotation speed of the cooling fan 26 is increased based on the first factor and determining that the rotation speed of the cooling fan 26 is decreased based on the second factor, the rotation speed of the cooling fan 26 may be maintained, increased or decreased according to the level of the rotation speed determined as being increased based on the first factor and the level of the rotation speed determined as being decreased based on the second factor.

According to one embodiment of the present disclosure, as described above, the rotation speed of the cooling fan 26 may be determined based on the operating ratio of the cooling fan 26. According to a modification, the operating ratio of the cooling fan may be formed by substituting the operating ratio of the cooling fan with the operating ratio of the damper. The rotation speed of the cooling fan 26 may be determined based on the operating ratio of the damper.

FIG. 7 is a graph illustrating the variation in an operating ratio of a cold air transmission unit and an output control of the cold air transmission unit.

In FIG. 7, the cold air transmission unit is a cooling fan by way of example. The reference signs V1 to V11 refer to rotation speeds of the cooling fan. In the present specification, the rotation speed of the cooling fan may be the output of the cold air transmission unit in FIG. 7.

V2 is less than V1, and V3 is less than V2. V4 is less than V3, and V5 is less than V4. V6 is greater than V5, V7 is greater than V6, and V8 is equal to V7. V9 is less than V8, and V10 and V11 are equal to V9.

Referring to FIG. 7, a method for controlling a refrigerator including a cold air generator, which generates cold air to cool a storage compartment, and a cold air transmission unit which transmits the cold air to the storage compartment may include operating the cold air generator for a specific time with an output previously determined.

The control method may include determining, by the controller, the output of the cold air transmission unit based on the current temperature of the storage compartment, which is sensed by the temperature sensor, when the specific time is elapsed. The control method may include operating by the controller, the cold air transmission unit with the determined output.

When the absolute value of the difference between the operating ratio of the cold air transmission unit in the previous step and the operating ratio of the cold air transmission unit in the current step is less than the first reference value, and when the difference between the target operating ratio of the cold air transmission unit and the operating ratio of the cold air transmission unit in the current stage is equal to or greater than the first upper limit reference value (e.g., H1), the controller may determine the output of the cold air transmission unit to be increased.

When the difference between the target operating ratio of the cold air transmission unit and the operating ratio of the cold air transmission unit in the current stage is equal to or greater than a first lower limit reference value (e.g., H2), the controller may determine the output of the cold air transmission unit to be decreased (for example, see that the output of the cold air transmission unit is decreased from V2 to V3 in FIG. 7).

In addition, when the absolute value of the difference value between the operating ratio (or on time or off time) of the cold air transmission unit in the previous step and the operating ratio (or on time or off time) of the cold air transmission unit in the current step is greater than the first reference value, and when the difference between the target operating ratio (or on time or off time) of the cold air transmission unit and the operating ratio (or on time or off time) of the cold air transmission unit in the current stage is equal to or greater than the first upper limit reference value, the controller may determine the output of the cold air transmission unit to be increased.

In addition, when the absolute value of the difference value between the operating ratio (or on time or off time) of the cold air transmission unit in the previous step and the operating ratio (or on time or off time) of the cold air transmission unit in the current step is greater than the first reference value, and when the difference between the target operating ratio (or on time or off time) of the cold air transmission unit and the operating ratio (or on time or off time) of the cold air transmission unit in the current stage is equal to or greater than the first lower limit reference value, the controller may determine the output of the cold air transmission unit to be decreased.

When the difference between the target operating ratio (or on time or off time) of the cold air transmission unit and the operating ratio (or on time or off time) of the cold air transmission unit in the current stage is less than the first upper limit reference value or the first lower limit reference value, the controller may perform a control operation such that the output of the cold air transmission unit is maintained.

While the cold air transmission unit is operated with the output decreased or increased as the controller determines the output of the cold air transmission unit to be decreased or increased, when the absolute value of the difference value between the operating ratio (or on time or off time) of the cold air transmission unit in the previous step and the operating ratio (or on time or off time) of the cold air transmission unit in the current step is less than the first reference value, and when the absolute value of the difference between the target operating ratio (or on time or off time) of the cold air transmission unit and the operating ratio (or on time or off time) of the cold air transmission unit in the current stage is equal to or greater than the first upper limit reference value or the first lower limit reference value, the controller may determine the output of the cold air transmission unit to be decreased or increased again (the output is decreased/increased again when the same condition is satisfied after a specific period of time is elapsed).

According to another embodiment of the present disclosure, the operating ratio of the cold air transmission unit may be formed by substituting the operating ratio of the cold air transmission unit with a time at which the output of the cold air transmission unit is maintained increased as compared to that in the previous step.

According to still another embodiment of the present disclosure, the operating ratio of the cold air transmission unit may be formed by substituting the operating ratio of the cold air transmission unit with a time at which the output of the cold air transmission unit is maintained decreased as compared to that in the previous step.

The reference values (which are determined through an output variation table based on the variation (previous value-current value) of the temperatures measured at specific time intervals) may be set at equal intervals or irregular intervals.

The specific time intervals may be equal time intervals, or irregular time intervals. For example, the interval in a satisfaction range may be greater than the interval in a dissatisfaction range.

The upper limit reference value or the lower limit reference value may be set to be equal to or different from the reference value.

FIG. 8 is a view schematically showing the configuration of a refrigerator according to a second embodiment of the present disclosure.

Referring to FIG. 8, the refrigerator 1A according to the second embodiment of the present disclosure may include a cabinet 10, in which a freezing compartment 111*a* and a refrigerating compartment 112*a* are formed, and doors (not shown) coupled to the cabinet 10 to open and close the freezing compartment 111*a* and the refrigerating compartment 112*a*.

The freezing compartment 111*a* and the refrigerating compartment 112*a* may be horizontally or vertically partitioned by a partitioning wall 113*a* in the cabinet 10. A cold air hole may be formed in the partitioning wall 113*a*, and a damper 12 may be installed in the cold air hole to open or close the cold air hole.

The refrigerator 1A may further include a freezing cycle 20 for cooling the freezing compartment 111*a* and/or the refrigerating compartment 112*a*.

The freezing cycle 20 may be equal to that of the first embodiment and thus a detailed description thereof will be omitted.

In the freezing cycle 20, the evaporator 24 may include a freezing compartment evaporator.

The refrigerator 1A may include a cooling fan 26 for enabling air to flow toward the evaporator 24 for cold air circulation of the freezing compartment 111*a*, and a fan driving unit 25 for driving the cooling fan 26.

In the present embodiment, the compressor 21 and the cooling fan 26 need to operate to supply cold air to the freezing compartment 111*a*, and the compressor 21 and the cooling fan 26 need to operate and the damper 12 needs to be open to supply cold air to the refrigerating compartment 112*a*. At this time, the damper 12 may operate by a damper motor 114*a*.

The compressor 21, the cooling fan 26 (or the fan driving unit 25) and the damper 12 (or the damper motor 114*a*) may be referred to as a "cooling unit" which operates to cool the storage compartment. The cooling unit may include one or more of a cold air generator and a cold air transmission unit (cold air transmitter).

The cooling unit may include at least one of the cold air generator which operates to generate cold air or the cold air transmission unit which operates to transmit the cold air.

In the present embodiment, the compressor 21 may be called a cold air generator and the cooling fan 26 and the damper 12 may be called a cold air transmission unit.

In the present disclosure, the cooling power of the cold air generator may mean the cooling power of the compressor 21 and the output of the cold air transmission unit may mean the rotation speed of the cooling fan 26 and/or the opening angle of the damper 12.

When the cold air transmission unit is the damper 12, the operating ratio of the damper 12 may mean a ratio of an ON time to a sum of the ON time and the OFF time of the damper 12 in one ON/OFF period of the cooling fan 26.

In the present embodiment, a state in which the damper 12 is closed is defined as a state in which the cold air transmission unit is turned off and a state in which the damper 12 is open is defined as a state in which the cold air transmission unit is turned on.

When the cold air transmission unit is the damper 12, the operating ratio of the damper may mean a ratio of the opening time of the damper 12 to a sum of one closing time of the damper 12 and one opening time of the damper 12.

The refrigerator 1A may further include a freezing compartment temperature sensor 41*a* for detecting the temperature of the freezing compartment 111*a*, a freezing compartment temperature sensor 42*a* for detecting the temperature of the refrigerating compartment 112*a*, and a controller 50 for controlling the cold air generator based on the temperatures detected by the temperature sensors 41*a* and 42*a*.

The controller 50 may control one or more of the compressor 21 and the cooling fan 26 such that the temperature of the freezing compartment 111*a* is maintained at a set temperature (or a target temperature).

For example, the rotation speed of the cooling fan 26 may be controlled based on the operating ratio of the cooling fan 26 using the same method as the control method described in the first embodiment.

The controller 50 may control the output of one or more of the compressor 21, the cooling fan 26 and the damper 12 in order to maintain the temperature of the refrigerating compartment 112*a* at the set temperature.

For example, the opening angle of the damper 12 may be controlled based on the operating ratio of the damper 12 according to the same pattern as the control method described in the first embodiment.

For example, when the refrigerator 1A is turned on, the controller 50 may perform preliminary operation for constant temperature control. For example, the controller 50 may perform control such that the compressor 21 operates with set cooling power and the cooling fan 26 operates at a set speed. In addition, the controller 50 may perform control such that the damper 12 is opened at a set angle.

The set cooling power of the compressor 21 may be, for example, maximum cooling power or cooling power close to the maximum cooling power, such that the temperature of the refrigerating compartment 112*a* rapidly drops. In addition, the set speed of the cooling fan 26 may be, for example, a maximum speed or a speed close to the maximum speed. In addition, the opening angle of the damper 12 may be a maximum angle or an angle close to the maximum angle.

When the compressor 21 and the cooling fan 26 operate and the damper 12 is opened at the set angle, the temperature of the refrigerating compartment 112*a* drops.

Upon determining that the temperature of the refrigerating compartment 112*a* reaches the lower limit temperature A2, the controller 50 may perform control to perform the temperature stabilization operation.

For example, the controller 50 may perform control such that the compressor 21 operates with the reference cooling power. The reference cooling power may be less than the intermediate cooling power between the maximum cooling power and the minimum cooling power of the compressor 21.

In addition, the controller 50 may change the opening angle of the damper 12 such that the damper 12 is closed or the opening angle of the damper 12 becomes a limited angle. The limited angle may be equal to or greater than the minimum angle of the damper 12, for example.

When the damper 12 is closed or the opening angle of the damper 12 is adjusted to the limited angle, the temperature of the refrigerating compartment 112*a* may increase.

The controller 50 may determine whether the temperature of the refrigerating compartment 112*a* is equal to or greater than the first reference temperature while the compressor 21 operates.

When the temperature of the refrigerating compartment 112*a* is equal to or greater than the first reference temperature, the controller 50 may set the opening angle of the damper 12 to a first reference angle in a state in which the compressor 21 operates.

In the present embodiment, the first reference angle may be greater than the limited angle.

For example, when the damper 12 is opened at the first reference angle, the first reference angle may be set to decrease the temperature of the refrigerating compartment 112*a*.

Since the amount of cold air supplied to the refrigerating compartment 112*a* when the damper 12 is opened at the first reference angle is greater than that of cold air supplied to the refrigerating compartment 112*a* when the damper 12 is opened at the limited angle, the temperature of the refrigerating compartment 112*a* may decrease.

The first reference angle may be a fixed angle. Alternatively, the first reference angle may be changed once or more.

When the first reference angle is changed once or more, the first reference angle may be changed from the first angle to the second angle less than the first angle.

When the damper 12 is opened at a first angle, the amount of cold air supplied to the refrigerating compartment 112*a* is large and thus the temperature decreasing speed of the refrigerating compartment 112*a* may increase.

After the temperature of the refrigerating compartment 112*a* decreases to some extent, the opening angle of the damper 12 may decrease to a second angle, thereby reducing the temperature decreasing speed of the refrigerating compartment 112*a*. In this case, it is possible to reduce the temperature change range of the refrigerating compartment 112*a* per unit time.

At this time, a time when the opening angle of the damper 12 is changed from the first angle to the second angle may be determined by a time or based on the temperature of the refrigerating compartment 112*a*.

For example, when the damper 12 is opened at a first angle and a set time has elapsed, the damper 12 may be opened at a second angle.

Alternatively, in a state in which the damper 12 is opened at the first angle, when the temperature of the refrigerating compartment 112*a* reaches a predetermined temperature between the first reference temperature and the second reference temperature, the damper 12 may be opened at the second angle.

When the temperature of the refrigerating compartment 112*a* is equal to or less than the second reference temperature, the controller 50 may perform control to perform constant-temperature operation.

The controller 50 may perform control to repeat operation of closing and then opening the damper 12 in the constant-temperature operating step In the present embodiment, a period in which the damper 12 is closed, opened and closed again may be referred to as one operating period.

The controller 50 may calculate the operating ratio of the damper 12 for each operating period in two operating periods in the constant-temperature operating step and determine the opening angle of the damper 12 based on the calculated two operating ratios. The controller 50 may operate the damper 12 with the determined opening angle in a next operating period.

In the present embodiment, the operating ratio of the damper 12 means an operating ratio of the damper motor 114*a*.

When the temperature of the refrigerating compartment 112*a* is equal to or less than the second reference temperature, the controller 50 performs control to close the damper 12 in a state in which operation of the compressor 21 is maintained.

When the damper 12 is closed, the temperature of the refrigerating compartment 112*a* may increase. The controller 50 may perform control to open the damper 12 at a second reference angle, upon determining that the temperature of the refrigerating compartment 112*a* is equal to or greater than the first reference temperature.

When the damper 12 is opened at the second reference angle, the temperature of the refrigerating compartment 112*a* may drop.

The second reference angle may be equal to or different from the first reference angle.

The second reference angle may be fixed or changed once or more like the first reference angle. Change in second reference angle may be equal to change in the first reference angle and thus a detailed description thereof will be omitted.

In a state in which the damper 12 is opened at the second reference angle, upon determining that the temperature of the refrigerating compartment 112*a* becomes equal to or less than the second reference temperature, the controller 50 may calculate the operating ratio of the damper 12 based on the closing time and opening time of the damper 12. The calculated operating ratio of the damper 12 may be stored in the memory 44.

Upon determining that the temperature of the refrigerating compartment 112*a* becomes equal to or less than the second reference temperature, the controller 50 may perform control to close the damper 12 in a state of maintaining operation of the compressor 21.

When the damper 12 is closed, the temperature of the refrigerating compartment 112*a* may increase. In a state in which the damper 12 is closed, upon determining that the temperature of the refrigerating compartment 112*a* becomes equal to or greater than the first reference temperature, the controller 50 may perform control such that the damper 12 is opened at a third reference angle. When the damper 12 is opened at the third reference angle, the temperature of the refrigerating compartment 112*a* may drop.

The third reference angle may be equal to one or more of the first reference angle and the second reference angle or may be different from the first reference angle and the second reference angle.

The third reference angle may be fixed or changed once or more like the first reference angle. Change in third reference angle may be equal to change in the first reference angle and thus a detailed description thereof will be omitted.

In a state in which the damper 12 is opened at the third reference angle, upon determining that the temperature of the refrigerating compartment 112*a* becomes equal to or less than the second reference temperature, the controller 50 may calculate the operating ratio of the damper 12 based on the closing time and opening time of the damper 12. The calculated operating ratio of the damper 12 may be stored in the memory 44.

That is, the operating ratio of the damper 12 may be calculated for each operating period and stored in the memory 44.

When the current operating ratio is calculated, the controller 50 may compare the previous operating ratio with the current operating ratio and determine the opening angle of the damper 12. The controller 50 may operate the damper 12 with the determined opening angle.

That is, the controller 50 may perform control such that the damper 12 operates with the determined opening angle in a next operating period.

As described in the first embodiment, the controller 50 may compare the previous operating ratio with the current operating ratio and determine the opening angle of the damper 12.

In another example, the controller 50 may compare the reference operating ratio of the damper 12 with the current operating ratio and determine the opening angle of the damper 12.

In another example, the controller 50 may maintain the opening angle of the damper 12 in the current state or may increase or decrease the opening angle of the damper 12, based on a first factor (the difference between the previous operating ratio and the current operating ratio) and a second factor (the difference between the reference operating ratio and the current operating ratio) for adjusting the opening angle of the damper 12. The method of determining the opening angle of the damper 12 based on the first factor and the second factor is equal to that described in the first embodiment and thus a detailed description thereof will be omitted.

FIG. 9 is a view schematically showing the configuration of a refrigerator according to a third embodiment of the present disclosure.

Referring to FIG. 9, the refrigerator 1B according to the third embodiment of the present disclosure may include a cabinet 10, in which a freezing compartment 111*a* and a refrigerating compartment 112*b* are formed, and doors (not shown) coupled to the cabinet 10 to open and close the freezing compartment 111*a* and the refrigerating compartment 112*a*.

The freezing compartment 111*a* and the refrigerating compartment 112*a* may be horizontally or vertically partitioned by a partitioning wall 113*a* in the cabinet 10.

The refrigerator 1B may further include a condenser 22, an expansion member 23, a freezing compartment evaporator 30 (or a first evaporator) for cooling the freezing compartment 111*a* and a refrigerating compartment evaporator 30*a* (or a second evaporator) for cooling the refrigerating compartment 112*a*.

The refrigerator 1B may include a switch valve 38 for enabling the refrigerant, which has passed through the expansion member 23, to flow to any one of the freezing compartment evaporator 30 and the refrigerating compartment evaporator 30*a*.

In the present embodiment, a state in which the switch valve 38 operates such that the refrigerant flows to the freezing compartment evaporator 30 may be referred to as a first state. In addition, a state in which the switch valve 38 operates such that the refrigerant flows to the refrigerating compartment evaporator 30*a* may be referred to as a second state. The switch valve 38 may be a three-way valve, for example.

The switch valve 38 may selectively open any one of a first refrigerant passage connected such that refrigerant flows between the compressor 21 and the refrigerating compartment evaporator 30*a* and a second refrigerant passage connected such that refrigerant flows between the compressor 21 and the freezing compartment evaporator 30. By the switch valve 38, cooling of the refrigerating compartment 112*a* and cooling of the freezing compartment 111*a* may be alternately performed.

The refrigerator 1B may include a freezing compartment fan 32 (which may be referred to as a first fan) for blowing air to the freezing compartment evaporator 30, a first motor 31 for rotating the freezing compartment fan 32, a refrigerating compartment fan 32*a* (which may be referred to as a second fan) for blowing air to the refrigerating compartment evaporator 30*a* and a second motor 31*a* for rotating the refrigerating compartment fan 32*a*.

In the present embodiment, a series of cycles in which refrigerant flows through the compressor 21, the condenser 22, the expansion member 23 and the freezing compartment evaporator 30 may be referred to as a "freezing cycle" and a series of cycles in which refrigerant flows through the compressor 21, the condenser 22, the expansion member 23 and the refrigerating compartment evaporator 30*a* may be referred to as a "refrigerating cycle".

"Operation of the refrigerating cycle" mean that the compressor 21 is turned on, the refrigerating compartment fan 32*a* is rotated, and the refrigerant flowing through the refrigerating compartment evaporator 30*a* exchanges heat with air while the refrigerant flows through the refrigerating compartment evaporator 30*a* by the switch valve 38.

"Operation of the freezing cycle" mean that the compressor 21 is turned on, the freezing compartment fan 32 is rotated, the refrigerant flowing through the freezing compartment evaporator 30 exchanges heat with air while the refrigerant flows through the freezing compartment evaporator 30 by the switch valve 38.

Although one expansion member 23 is located at the upstream side of the switch valve 38 in the above description, a first expansion member is provided between the switch valve 38 and the freezing compartment evaporator 30, and a second expansion member is provided between the switch valve 38 and the refrigerating compartment evaporator 30*a*.

In another example, the switch valve 38 may not be used, a first valve may be provided at the inlet side of the freezing compartment evaporator 30, and a second valve may be provided at the inlet side of the refrigerating compartment evaporator 30*a*. The first valve may be turned on and the second valve may be turned off during operation of the freezing cycle and the first valve may be turned off and the second valve may be turned on during operation of the refrigerating cycle.

The refrigerating compartment fan and the compressor may be referred to as a first cooling unit for cooling a first storage compartment and the freezing compartment fan may be referred to as a second cooling unit for cooling a second storage compartment.

The refrigerator 1B may include a freezing compartment temperature sensor 41*a* for detecting the temperature of the freezing compartment 111*a*, a refrigerating compartment temperature sensor 42*a* for detecting the temperature of the refrigerating compartment 112*a*, an input unit (not shown) for inputting the respective target temperatures (or set temperatures) of the freezing compartment 111*a* and the refrigerating compartment 112*a*, and a controller 50 for controlling a cooling cycle (including the freezing cycle and the refrigerating cycle) based on the input target temperatures and the temperatures detected by the temperature sensors 41*a* and 42*a*.

In addition, in the present disclosure, a temperature higher than the set temperature of the refrigerating compartment 112*a* may be referred to as a first refrigerating compartment reference temperature and a temperature lower than the set temperature of the refrigerating compartment 112*a* may be referred to as a second refrigerating compartment reference temperature. In addition, a range between the first refrigerating compartment reference temperature and the second refrigerating compartment reference temperature may be referred to as a refrigerating compartment set temperature range.

In the present disclosure, a temperature higher than the set temperature of the freezing compartment 111*a* is referred to as a first freezing compartment reference temperature, and a temperature lower than the set temperature of the freezing compartment 111*a* may be a second freezing compartment reference temperature. In addition, a range between the first freezing compartment reference temperature and the second freezing compartment reference temperature may be referred to as a freezing compartment set temperature range.

In the present embodiment, a user may set the respective target temperatures of the freezing compartment 111*a* and the refrigerating compartment 112*a*.

In the present embodiment, the controller 50 may perform control such that a refrigerating cycle, a freezing cycle and a pump-down cycle configure one operating period. That is, the controller 50 may operate the cycle while continuously operating the compressor 21 without stopping.

In the present embodiment, the pump-down operation means operation of operating the compressor 21 to collect refrigerant remaining in each evaporator in the compressor 21 in a state in which supply of the refrigerant to all a plurality of evaporators is prevented.

The controller 50 operates the refrigerating cycle, and operates the freezing cycle when the stop condition of the refrigerating cycle is satisfied. When the stop condition of the freezing cycle is satisfied while the freezing cycle operates, the pump-down operation may be performed. When the pump-down operation is completed, the refrigerating cycle may operate again.

In the present embodiment, when the stop condition of the refrigerating cycle is satisfied, cooling of the refrigerating compartment may be regarded as being completed. In addition, when the stop condition of the freezing cycle is satisfied, cooling of the freezing compartment may be regarded as being completed.

At this time, in the present disclosure, the stop condition of the refrigerating cycle may be the start condition of the freezing cycle.

In the present embodiment the pump-down operation may be omitted under a special condition. In this case, the refrigerating cycle and the freezing cycle may alternately operate. The refrigerating cycle and the freezing cycle may configure one operating period.

In one operating period, the operating ratio of the refrigerating compartment fan 32*a* may be determined.

For example, in one operating period, when the refrigerating cycle operates, the refrigerating compartment fan 32*a* may be turned on, and, when the freezing cycle operates, the refrigerating compartment fan 32*a* may be turned off. Accordingly, the operating ratio of the refrigerating compartment fan 32*a* which is a ratio of the ON time of the refrigerating compartment fan 32*a* to a sum of the ON time and OFF time of the refrigerating compartment fan 32*a* may be determined.

The controller 50 may determine the rotation speed of the refrigerating compartment fan 32*a* during operation of the refrigerating cycle based on the determined operating ratio of the refrigerating compartment fan 32*a*.

As described above in the first embodiment, the controller 50 may compare the previous operating ratio of the refrigerating compartment fan 32*a* with the current operating ratio of the refrigerating compartment fan 32*a* and determine the rotation speed of the refrigerating compartment fan 32*a* during operation of the refrigerating cycle.

In another example, the controller 50 may compare the reference operating ratio of the refrigerating compartment fan 32*a* with the current operating ratio of the refrigerating compartment fan 32*a* and determine the rotation speed of the refrigerating compartment fan 32*a* during operation of the refrigerating cycle.

In another example, the controller 50 may maintain the rotation speed of the refrigerating compartment fan 32*a* in the current state or may increase or decrease the rotation speed of the refrigerating compartment fan 32*a*, based on a first factor (the difference between the previous operating ratio of the refrigerating compartment fan and the current operating ratio of the refrigerating compartment fan) and a second factor (the difference between the reference operating ratio and the current operating ratio of the refrigerating compartment fan) for adjusting the rotation speed of the refrigerating compartment fan 32*a*.

In addition, in one operating period, the operating ratio of the freezing compartment fan 32 may be determined.

For example, in one operating period, when the freezing cycle operates, the freezing compartment fan 32 may be turned on, and, when the refrigerating cycle operates, the freezing compartment fan 32 may be turned off. Accordingly, the operating ratio of the freezing compartment fan 32 which is a ratio of the ON time of the freezing compartment fan 32 to a sum of the ON time and OFF time of the freezing compartment fan 32 may be determined.

The controller 50 may determine the rotation speed of the freezing compartment fan 32 during the freezing cycle based on the determined operating ratio of the freezing compartment fan 32.

As described above in the first embodiment, the controller 50 may compare the previous operating ratio of the freezing compartment fan 32 with the current operating ratio of the freezing compartment fan 32 and determine the rotation speed of the freezing compartment fan 32 during operation of the freezing cycle.

In another example, the controller 50 may compare the reference operating ratio of the freezing compartment fan 32 with the current operating ratio of the freezing compartment fan 32 and determine the rotation speed of the freezing compartment fan 32 during operation of the freezing cycle.

In another example, the controller 50 may maintain the rotation speed of the freezing compartment fan 32 in the current state or may increase or decrease the rotation speed of the freezing compartment fan 32, based on a first factor (the difference between the previous operating ratio of the freezing compartment fan and the current operating ratio of the freezing compartment fan) and a second factor (the difference between the reference operating ratio and the current operating ratio of the freezing compartment fan) for adjusting the rotation speed of the freezing compartment fan 32.

FIG. 10 is a view schematically showing the configuration of a refrigerator according to a fourth embodiment of the present disclosure.

Referring to FIG. 10, the refrigerator 1C according to the fourth embodiment of the present disclosure may include a cabinet 10, in which a freezing compartment 111*b* and a refrigerating compartment 112*b* are formed, and doors (not shown) coupled to the cabinet 10 to open and close the freezing compartment 111*b* and the refrigerating compartment 112*b*.

The freezing compartment 111*b* and the refrigerating compartment 112*b* may be horizontally or vertically partitioned by a partitioning wall 113*b* in the cabinet 10.

In addition, the refrigerator 1C may include a cooling cycle for cooling the freezing compartment 111*b* and the refrigerating compartment 112*b*.

The cooling cycle may include a freezing cycle for cooling the freezing compartment 111*b* and a refrigerating cycle for cooling the refrigerating compartment 112*b*.

The refrigerating cycle may include a freezing compartment compressor 21*a* (or a first compressor), a condenser 35, a first expansion member 36, a first evaporator 37 and a freezing compartment fan 39.

The freezing compartment fan 39 may rotate by a first motor 38. The freezing compartment fan 39 may blow air toward the first evaporator 37 for cold air circulation of the freezing compartment 111*b*.

In the present embodiment, the freezing compartment compressor 21*a* and the freezing compartment fan 39 may be referred to as a "freezing compartment cooling unit" for cooling the freezing compartment 111*b*.

The refrigerating cycle may include a refrigerating compartment compressor 21*b* (or a second compressor), a condenser 35, a second expansion member 36*a*, a second evaporator 37*a* and a refrigerating compartment fan 39*a*.

The refrigerating compartment fan 39*a* may rotate by a second motor 38*a*. The refrigerating compartment fan 39*a* may blow air toward the second evaporator 37*a* for cold air circulation of the refrigerating compartment 112*b*.

In the present embodiment, the refrigerating compartment compressor 21*b* and the refrigerating compartment fan 39*a* may be referred to as a "refrigerating compartment cooling unit" which operates to cool the refrigerating compartment 112*b*.

At this time, the condenser 35 configures one heat exchanger and is divided into two parts such that refrigerant flows. That is, refrigerant discharged from the first compressor 21*a* may flow to a first part 351 of the condenser 35 and refrigerant discharged from the second compressor 21*b* may flow to a second part 352 of the condenser 35. A condenser pin for the first part 351 and a condenser pin for the second part 352 may be connected to increase condensation efficiency of the condenser.

Compared to the case where two separate condensers are installed in a machine room, it is possible to increase the condensing efficiency of the condenser while reducing the installation space of the condenser. Accordingly, the first part 351 may be referred to as a first condenser and the second part 352 may be referred to as a second condenser.

The refrigerator 1C may further include a controller for controlling the cooling cycle based on the temperatures of the freezing compartment 111*b* and/or the refrigerating compartment 112*b* input through an input unit (not shown) and the temperatures detected by a freezing compartment temperature sensor and/or a refrigerating compartment temperature sensor (not shown).

In the present embodiment, a temperature higher than the target temperature of the freezing compartment 111*b* is referred to as a first freezing compartment reference temperature, and a temperature lower than the target temperature of the freezing compartment 111*b* may be referred to as a second freezing compartment reference temperature. In addition, a range between the first freezing compartment reference temperature and the second freezing compartment reference temperature may be referred to as a freezing compartment set temperature range.

In the present embodiment, the controller performs control such that the temperature of the freezing compartment 111*b* is maintained in the set temperature range. At this time, control to maintain the temperature of the freezing compartment 111*b* in the set temperature range is referred to as constant temperature control of the freezing compartment.

In addition, in the present embodiment, a temperature higher than the target temperature of the refrigerating compartment 112*b* is referred to as a first refrigerating compartment reference temperature, and a temperature lower than the target temperature of the refrigerating compartment 112*b* may be referred to as a second refrigerating compartment reference temperature. In addition, a range between the first refrigerating compartment reference temperature and the second refrigerating compartment reference temperature may be referred to as a refrigerating compartment set temperature range.

In the present embodiment, the controller performs control such that the temperature of the refrigerating compartment 112*b* is maintained in the set temperature range. At this time, control to maintain the temperature of the refrigerating compartment 112*b* in the set temperature range is referred to as constant temperature control of the refrigerating compartment.

The cooling cycle for the freezing compartment 111*b* and the refrigerating compartment 112*b* may configure respective cooling cycles such that the cooling units independently operate according to the first reference temperature and the second reference temperature of the freezing compartment 111*b* and the first reference temperature and the second reference temperature of the refrigerating compartment 112*b*.

For example, the refrigerating cycle may stop, and the freezing cycle may operate for constant temperature control of the freezing compartment 111*b*. For constant temperature control of the freezing compartment 111*b*, the freezing compartment compressor 21*a* and the freezing compartment fan 39 may operate.

When the refrigerating cycle operates, the temperature of the freezing compartment 111*b* drops. In contrast, in a state in which the refrigerating cycle is stopped, the temperature of the refrigerating compartment 112*b* rises.

During operation of the refrigerating cycle, upon determining that the detected temperature of the refrigerating compartment reaches the first refrigerating compartment reference temperature, the controller operates the refrigerating cycle. That is, in order to reduce the temperature of the refrigerating compartment 112*b*, the controller operates the refrigerating compartment compressor 21*b* and the refrigerating compartment fan 39*a*.

At least some periods in which the refrigerating cycle operates, the freezing compartment compressor 21*a* and the freezing compartment fan 39 may be turned off.

At least some periods in which the freezing cycle operates, the refrigerating compartment compressor 21*b* and the refrigerating compartment fan 39*a* may be turned off.

When the operation condition of the refrigerating cycle is satisfied during operation of the refrigerating cycle, the controller may operate the freezing cycle.

The freezing compartment fan 39 may be repeatedly turned on and off by repetition of operation of the refrigerating cycle and operation of the refrigerating cycle, and the refrigerating compartment fan 39*a* is also repeatedly turned on and off.

The controller may calculate the operating ratio of the freezing compartment fan 39 using the ON time and OFF time of the freezing compartment fan 39. In addition, the controller may calculate the operating ratio of the refrigerating compartment fan 39*a* using the ON time and OFF time of the refrigerating compartment fan 39*a*.

The controller may determine the rotation speed of the freezing compartment fan 39 during the freezing cycle based on the operating ratio of the freezing compartment fan 39.

As described above in the first embodiment, the controller may compare the previous operating ratio of the freezing compartment fan 39 with the current operating ratio of the freezing compartment fan 39 and determine the rotation speed of the freezing compartment fan 39 during operation of the refrigerating cycle.

In another example, the controller may compare the reference operating ratio of the freezing compartment fan 39 with the current operating ratio of the freezing compartment fan 39 and determine the rotation speed of the freezing compartment fan 39 during operation of the freezing cycle.

In another example, the controller may maintain the rotation speed of the freezing compartment fan 39 in the current state or may increase or decrease the rotation speed of the freezing compartment fan 39, based on a first factor (the difference between the previous operating ratio of the freezing compartment fan and the current operating ratio of the freezing compartment fan) and a second factor (the difference between the reference operating ratio and the current operating ratio of the freezing compartment fan) for adjusting the rotation speed of the freezing compartment fan 39.

The controller may determine the rotation speed of the refrigerating compartment fan 39*a* during operation of the refrigerating cycle based on the operating ratio of the refrigerating compartment fan 39*a*.

As described above in the first embodiment, the controller may compare the previous operating ratio of the refrigerating compartment fan 39*a* with the current operating ratio of the refrigerating compartment fan 39*a* and determine the rotation speed of the refrigerating compartment fan 39*a* during operation of the freezing cycle.

In another example, the controller may compare the reference operating ratio of the refrigerating compartment fan 39*a* with the current operating ratio of the refrigerating compartment fan 39*a* and determine the rotation speed of the refrigerating compartment fan 39*a* during operation of the freezing cycle.

In another example, the controller may maintain the rotation speed of the refrigerating compartment fan 39*a* in the current state or may increase or decrease the rotation speed of the refrigerating compartment fan 39*a*, based on a first factor (the difference between the previous operating ratio of the refrigerating compartment fan and the current operating ratio of the refrigerating compartment fan) and a second factor (the difference between the reference operating ratio and the current operating ratio of the refrigerating compartment fan) for adjusting the rotation speed of the refrigerating compartment fan 39*a*.

In the present disclosure, the rotation speed of the cooling fan and the angle of the damper may be collectively referred to as output. For example, the reference speed of the cooling fan and the reference angle of the damper may be referred to as reference output. In addition, the set speed of the cooling fan may be referred to as set output of the cooling fan and the limited speed of the cooling fan may be referred to as the limited output of the cooling fan.

The invention claimed is:

1. A method for controlling a refrigerator based on a first reference temperature and a second reference temperature, the method comprising:

turning off a cold air transmission component when a temperature of a storage compartment becomes equal to or less than the second reference temperature while a cold air generator is operated;

turning on the cold air transmission component, when the temperature of the storage compartment is determined to be equal to or greater than the first reference temperature; and determining, by a controller, an operating ratio of the cold air transmission component based on an ON time and an OFF time of the cold air transmission component, determining an operating property of the cold air transmission component based on the determined operating ratio of the cold air transmission component, and operating the cold air transmission component at the determined operating property of the cold air transmission component, upon determining that the temperature of the storage compartment is equal to or less than the second reference temperature, and wherein the controller determines the operating property of the cold air transmission component, based on at least one of:

a difference between a previous operating ratio of the cold air transmission component and a current operating ratio of the cold air transmission component, or a difference between a reference operating ratio, which is previously determined, and the current operating ratio of the cold air transmission component.

2. The method of claim 1, wherein the cold air generator includes a compressor, and the cold air transmission component includes a cooling fan configured to provide cold air to the storage compartment, and wherein the determined operating property of the cold air transmission component is a rotation speed of the cooling fan.

3. The method of claim 1, wherein the cold air generator includes a compressor, and the cold air transmission component includes a damper configured to open or close a passage for providing cold air to the storage compartment, and wherein the determined operating property of the cold air transmission component is an open angle of the damper.

4. The method of claim 1, wherein the cold air transmission component is turned off again upon determining that the temperature of the storage compartment is equal to or less than the second reference temperature.

5. The method of claim 1, wherein the operating ratio of the cold air transmission component is determined based on a ratio of the ON time of the cold air transmission component to a sum of the ON time and the OFF time of the cold air transmission component during one operating cycle of the cold air transmission component.

6. The method of claim 1, wherein when the controller determines that an absolute value of the difference between the previous operating ratio and the current operating ratio is equal to or greater than a first reference value, the controller is to increase or decrease the operating property of the cold air transmission component, and when the controller determines that the absolute value of the difference between the previous operating ratio and the current operating ratio is less than the first reference value, the controller is to maintain the operating property of the cold air transmission component.

7. The method of claim 6, wherein when the controller determines that the difference between the previous operating ratio and the current operating ratio is less than zero, and that the absolute value of the difference between the previous operating ratio and the current operating ratio is equal to or greater than the first reference value, the controller is to increase the operating property of the cold air transmission component, and wherein when the controller determines that the difference between the previous operating ratio and the current operating ratio is greater than zero, and that the absolute value of the difference between the previous operating ratio and the current operating ratio is equal to or greater than the first reference value, the controller is to decrease the operating property of the cold air transmission component.

8. The method of claim 6, wherein when the controller determines that the absolute value of the difference between the previous operating ratio and the current operating ratio is equal to or greater than the first reference value, and that the difference between the previous operating ratio and the current operating ratio is less than a second reference value which is greater than the first reference value, the controller is to increase or decrease the operating property of the cold air transmission component by a first level, and when the controller determines that the absolute value of the difference between the previous operating ratio and the current operating ratio is equal to or greater than the second reference value, the controller is to increase or decrease the operating property of the cold air transmission component by a second level which is greater than the first level.

9. The method of claim 1, wherein when the controller determines that an absolute value of the difference between the reference operating ratio and the current operating ratio is equal to or greater than a first reference value, the controller is to increase or decrease the operating property of the cold air transmission component, and when the controller determines that the absolute value of the difference between the reference operating ratio and the current operating ratio is less than the first reference value, the controller is to maintain the operating property of the cold air transmission component.

10. The method of claim 9, wherein when the controller determines that the difference between the reference operating ratio and the current operating ratio is less than zero, and that the absolute value of the difference between the reference operating ratio and the current operating ratio is equal to or greater than the first reference value, the controller is to increase the operating property of the cold air transmission component, wherein when the controller determines that the difference between the reference operating ratio and the current operating ratio is greater than zero, and that the absolute value of the difference between the reference operating ratio and the current operating ratio is equal to or greater than the first reference value, the controller is to decrease the operating property of the cold air transmission component.

11. The method of claim 9, wherein when the controller determines that the absolute value of the difference between the reference operating ratio and the current operating ratio is equal to or greater than the first reference value, and that the difference between the reference operating ratio and the current operating ratio is less than a second reference value which is greater than the first reference value, the controller is to increase or decrease the operating property of the cold air transmission component by a first level, and wherein when the controller determines that the absolute value of the difference between the reference operating ratio and the current operating ratio is equal to or greater than the second reference value, the controller is to increase or decrease the operating property of the cold air transmission component by a second level which is greater than the first level.

12. The method of claim 1, wherein the controller controls the cold air transmission component to immediately operate at the determined operating property, upon determining that the temperature of the storage compartment is equal to or less than the second reference temperature.

13. The method of claim 1, wherein the cold air transmission component is turned off again upon determining that the temperature of the storage compartment is equal to or less than the second reference temperature, and wherein the controller determines a next output of the cold air transmission component based on the operating ratio of the cold air transmission component, and controls the cold air transmission component to operate at the determined operating property, when the cold air transmission component is turned on a next time.

14. A method for controlling a refrigerator based on a first reference temperature and a second reference temperature, the method comprising:

turning off a cold air transmission component when a temperature of a storage compartment becomes equal to or less than the second reference temperature while a cold air generator is operated;

turning on the cold air transmission component when the temperature of the storage compartment is determined to be equal to or greater than the first reference temperature; and determining, by a controller, an operating ratio of the cold air transmission component based on an ON time and an OFF time of the cold air transmission component, determining an operating property of the cold air transmission component based on the determined operating ratio of the cold air transmission component, and operating the cold air transmission component at the determined operating property of the cold air transmission component, upon determining that the temperature of the storage compartment is equal to or less than the second reference temperature, wherein the controller determines that the operating property of the cold air transmission component based on a first factor which is a difference between a previous operating ratio of the cold air transmission component and a current operating ratio of the cold air transmission component, and a second factor which is a difference between a reference operating ratio, which is previously determined, and the current operating ratio of the cold air transmission component.

15. The method of claim 14, further comprising:

determining, by the controller, whether to increase, maintain, or decrease the operating property of the cold air transmission component at a final stage by combining a result from the first factor with a result from the second factor, after determining the operating property of the cold air transmission component based on the first factor, and determining the operating property of the cold air transmission component based on the second factor.

16. A method for controlling a refrigerator having a first storage compartment, a second storage compartment, a cooling fan to provide cold air to the second storage compartment, and a compressor, the method comprising:

turning off the cooling fan when a temperature of the second storage compartment becomes equal to or less than a second reference temperature while the compressor is operated;

turning on the cooling fan, when the temperature of the second storage compartment is determined to be equal to or greater than a first reference temperature, wherein the first reference temperature is greater than the second reference temperature;

determining an operating ratio of the cooling fan based on an ON time and an OFF time of the cooling fan;

determining a rotational speed of the cooling fan based on the determined operating ratio of the cooling fan; and in response to determining that the temperature of the second storage compartment is equal to or less than the second reference temperature, operating the cooling fan at the determined rotational speed, wherein the rotational speed of the cooling fan is determined based on at least one of:

a difference between a previous of ratio of the cooling fan and a current operating ratio of the cooling fan, or a difference between a reference operating radio, which is previously determined, and the current operating ratio of the cooling fan.

17. The method of claim 16, wherein the operating ratio of the cooling fan is determined based on a ratio of the ON time to a sum of the ON time and the OFF time of the cooling fan.

* * * * *